US012358697B2

(12) United States Patent
Wong et al.

(10) Patent No.: US 12,358,697 B2
(45) Date of Patent: Jul. 15, 2025

(54) CLOSURE ASSEMBLY FOR A CONTAINER

(71) Applicant: AEGIS GLOBAL RESOURCES (HK) LIMITED, Hong Kong (HK)

(72) Inventors: Siu Wah Wong, Hong Kong (HK); Shun Sang Poon, Hong Kong (HK); Fat Sun Kwok, Hong Kong (HK)

(73) Assignee: AEGIS GLOBAL RESOURCES (HK) LIMITED, Hong Kong (HK)

( * ) Notice: Subject to any disclaimer, the term of this patent is extended or adjusted under 35 U.S.C. 154(b) by 90 days.

(21) Appl. No.: 18/374,249

(22) Filed: Sep. 28, 2023

(65) Prior Publication Data

US 2024/0109696 A1 Apr. 4, 2024

Related U.S. Application Data

(60) Provisional application No. 63/412,596, filed on Oct. 3, 2022.

(51) Int. Cl.

| | |
|---|---|
| ***B65D 50/04*** | (2006.01) |
| ***B65D 41/04*** | (2006.01) |
| ***B65D 55/16*** | (2006.01) |

(52) U.S. Cl.

CPC ..... *B65D 50/046* (2013.01); *B65D 41/0442* (2013.01); *B65D 55/16* (2013.01); *B65D 2215/02* (2013.01)

(58) Field of Classification Search

CPC .. B65D 50/046; B65D 41/0442; B65D 55/16; B65D 2215/02; B65D 47/0885

USPC ..... 215/216, 201

See application file for complete search history.

(56) References Cited

U.S. PATENT DOCUMENTS

| | | | | |
|---|---|---|---|---|
| 834,679 | A * | 10/1906 | Newton | B65D 55/16 220/291 |
| 6,085,935 | A * | 7/2000 | Malchow | D06F 43/085 220/291 |
| 8,292,110 | B2 * | 10/2012 | Rutter | B65D 47/0838 220/817 |

FOREIGN PATENT DOCUMENTS

| | | | | |
|---|---|---|---|---|
| FR | 3056387 | A1 * | 3/2018 | A45D 33/006 |
| JP | 3423224 | B2 * | 7/2003 | A45C 13/008 |
| JP | 3834256 | B2 * | 10/2006 | B65D 50/061 |
| JP | 4044144 | B2 * | 2/2008 | B65D 47/0838 |
| JP | 7536283 | B2 * | 8/2024 | B65D 50/041 |

* cited by examiner

*Primary Examiner* — Don M Anderson
*Assistant Examiner* — Eric C Baldrighi
(74) *Attorney, Agent, or Firm* — WPAT, PC

(57) ABSTRACT

A closure assembly for a container, comprising a coupling member adapted for engaging with an opening of the container and a lid assembly connected with the coupling member forming a closure for the opening. The lid assembly comprising a support member pivotably mounted to the coupling member, a closure member rotatably supported by the support member for allowing rotational movement with respect to the support member, and adapted for forming a closure engagement with an outlet of the coupling member. The closure assembly is provided with a locking mechanism configured for selectively maintaining the closure engagement, with the closure member rotatable between a first position in which the closure member and the outlet is sealed, and a second position in which the closure member is free to be disengaged from the outlet.

19 Claims, 20 Drawing Sheets

CLOSURE ASSEMBLY FOR A CONTAINER

FIELD OF THE INVENTION

The present invention relates to a closure assembly for a container. In particular, the present invention provides a closure assembly offering enhanced resealability, user control and sustainability.

BACKGROUND

Container closures have played a pivotal role in preserving various products, from food and beverages. Ensuring a tight seal to prevent leakage, maintaining product freshness, and ensuring ease of use are critical technical challenges in designing effective container closures. However, existing closure arrangements for containers suffer from several issues and disadvantages.

One major challenge is the potential for leakage and contamination associated with many conventional container closures, such as snap-on or screw-on lids. Improper sealing can result in spoilage, leakage and loss of pressure, especially concerning items like carbonated drinks. Additionally, traditional closures often lack mechanisms for controlling the ease of opening and closing, leading to difficulty in operation by the user, especially during exercising.

As regards efficiency of operation, some conventional closure arrangement can be cumbersome, especially for individuals with limited dexterity. Moreover, certain closure arrangements cannot be resealed easily once opened, contributing to product wastage, particularly when products need to be consumed or used over time. Many existing closure arrangements lack mechanisms to prevent unintentional disengagement of the closure thus causes accidental spillage. Lastly, some closure arrangements, such as single-use plastic caps, pose environmental concerns and contribute to pollution, while consumers increasingly seek sustainable and eco-friendly closure alternatives. In light of these challenges and disadvantages, there is a clear need for innovative container closure solutions that can address these issues.

SUMMARY OF THE INVENTION

In an effort to overcome or, at the very least, mitigate the shortcomings identified in the prior art, an aspect of the present invention provides a closure assembly for a container, comprising:

- a coupling member adapted for engaging with an opening of the container; and
- a lid assembly connected with the coupling member forming a closure for the opening, the lid assembly comprising:
- a support member pivotably mounted to the coupling member;
- a closure member rotatably supported by the support member for allowing rotational movement with respect to the support member, and adapted for forming a closure engagement with an outlet of the coupling member;

wherein the closure assembly is provided with a locking mechanism configured for selectively maintaining the closure engagement, with the closure member rotatable between a first position in which the closure member and the outlet is sealed, and a second position in which the closure member is free to be disengaged from the outlet.

In an embodiment, the locking mechanism comprises a retention member provided on the closure member, the retention member is adapted for engaging or disengaging with a protrusion on the coupling member as a result of rotation of the closure member from the first position to the second position or vice versa.

In an embodiment, the retention member is constructed as a detent extending into the outlet, and the protrusion is constructed as a rib disposed within the outlet, during said closure engagement the detent slides towards the rib along a circumferential direction within the outlet.

In an embodiment, the closure member is configured to bias towards the first position by a first resilient member provided between the closure member and the support member.

In an embodiment, the support member is provided with a stopper adapted for abutment against a baffle provided on the closure member, the abutment restricts the closure member to rotate further beyond the second position.

In an embodiment, a gasket is disposed in the closure member for forming a seal with the coupling member.

In an embodiment, the closure assembly is releasably coupled to the container through complimentary threads provided on the opening of the container and the coupling member.

In an embodiment, the closure assembly comprises an actuating mechanism for isolating direction manipulation of the closure member by a user, while selectively restricting or driving the rotation of the closure member by means of an actuator.

In an embodiment, the actuator is constructed as a cap substantially enclosed the closure member, the actuator is configured to engage with the closure member which rotatably supports the actuator.

In an embodiment, the closure member is provided with a upper annular slot for engagement with one or more arcuate protrusions provided within the actuator.

In an embodiment, the actuator is adapted for moving coaxially with respect to the closure member between an actuated position in which the actuator is rotatable with the closure member, and a de-actuated position in which rotation of the actuator is restricted.

In an embodiment, the actuator is provided with a drive protrusion engageable with a corresponding drive slot provided on the closure member, such that upon engagement the actuator drives the rotation of the closure member.

In an embodiment, the actuator is configured to bias towards the de-actuated position by a second resilient member provided between the closure member and the actuator.

In an embodiment, the actuator is provided with a lock catch that protrudes through an open slot disposed within the upper annular slot, in the de-actuated position the lock catch is engaged with a lock tongue provided on the coupling member, thereby restricts the rotation of the actuator.

In an embodiment, in the actuated position the lock catch is offset from the lock tongue, thereby allows the actuator to rotate.

According to another aspect of the present invention, there is provided a closure assembly for a container, comprising:

- a coupling member adapted for engaging with an opening of the container; and
- a lid assembly releasably connected with the coupling member, the coupling member and the lid assembly forming a closure for the opening, the lid assembly comprising:

a support member pivotably connected with the coupling member;

a closure member rotatably supported by the support member for allowing relative rotation, the closure member adapted for forming a seal with an outlet of the coupling member;

wherein the closure assembly further comprises:

a locking mechanism configured for selectively maintaining the closure engagement, with the closure member operatively rotatable between a first position in which the seal between the closure member and the outlet is maintained, and a second position in which the closure member is free to be disengaged from the outlet; and an actuating mechanism that isolates the closure member from direct manipulation by a user, and is configured for selectively allowing and restricting rotation of the closure member by means of an actuator.

In an embodiment, the actuator is constructed as a cap fitted over the closure member, the actuator is configured for selectively engaging with the closure member which rotatably supports the actuator.

In an embodiment, the actuator is adapted for moving coaxially with respect to the closure member between an actuated position in which the actuator is rotatable with the closure member, and a de-actuated position in which rotation of the actuator is restricted.

In an embodiment, the actuator is provided with a drive protrusion engageable with a corresponding drive slot provided on the closure member, such that upon engagement the actuator drives the rotation of the closure member.

In an embodiment, the actuator is configured to bias towards the de-actuated position by a second resilient member provided between the closure member and the actuator.

Further explanation of this invention is provided below with reference to the accompanying drawings in the following embodiment.

BRIEF DESCRIPTION OF THE DRAWINGS

The present invention will now be more specifically described by way of example only with reference to the accompanying drawings, in which.

All figures are not necessarily drawn to true scale.

DESCRIPTION OF THE PREFERRED EMBODIMENTS

The following clearly and completely describes the technical solutions in the embodiments of the present invention with reference to the accompanying drawings. Apparently, the described embodiments are merely some but not all of the embodiments of the present invention. All other embodiments based on the embodiments of the present invention and obtained by a person of ordinary skill in the art without investing creative efforts shall fall within the scope of the present invention.

Figure 1:
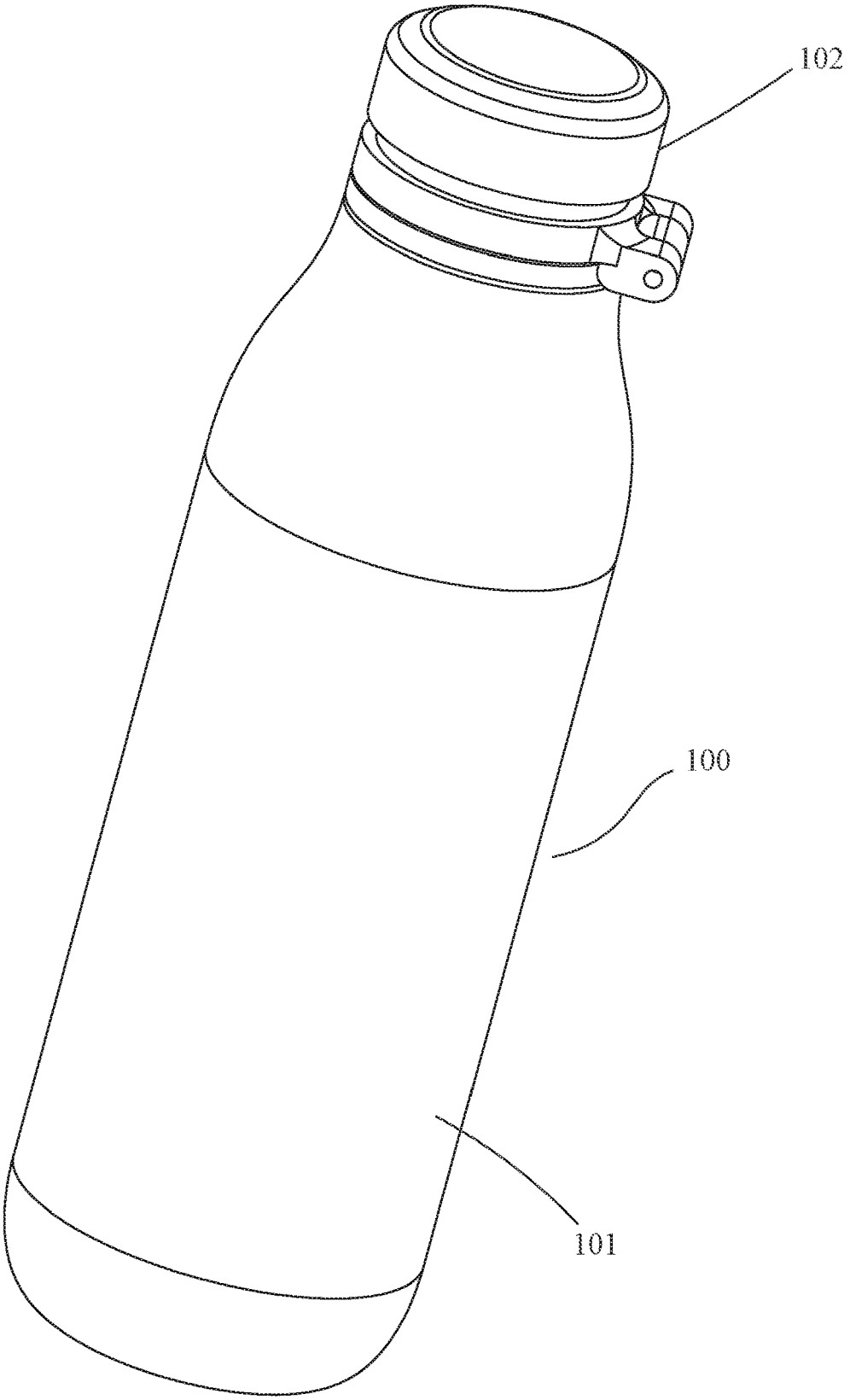
FIG. 1 is a perspective view of a container fitted with a closure assembly according to a first embodiment of the present invention.
Figure 2:
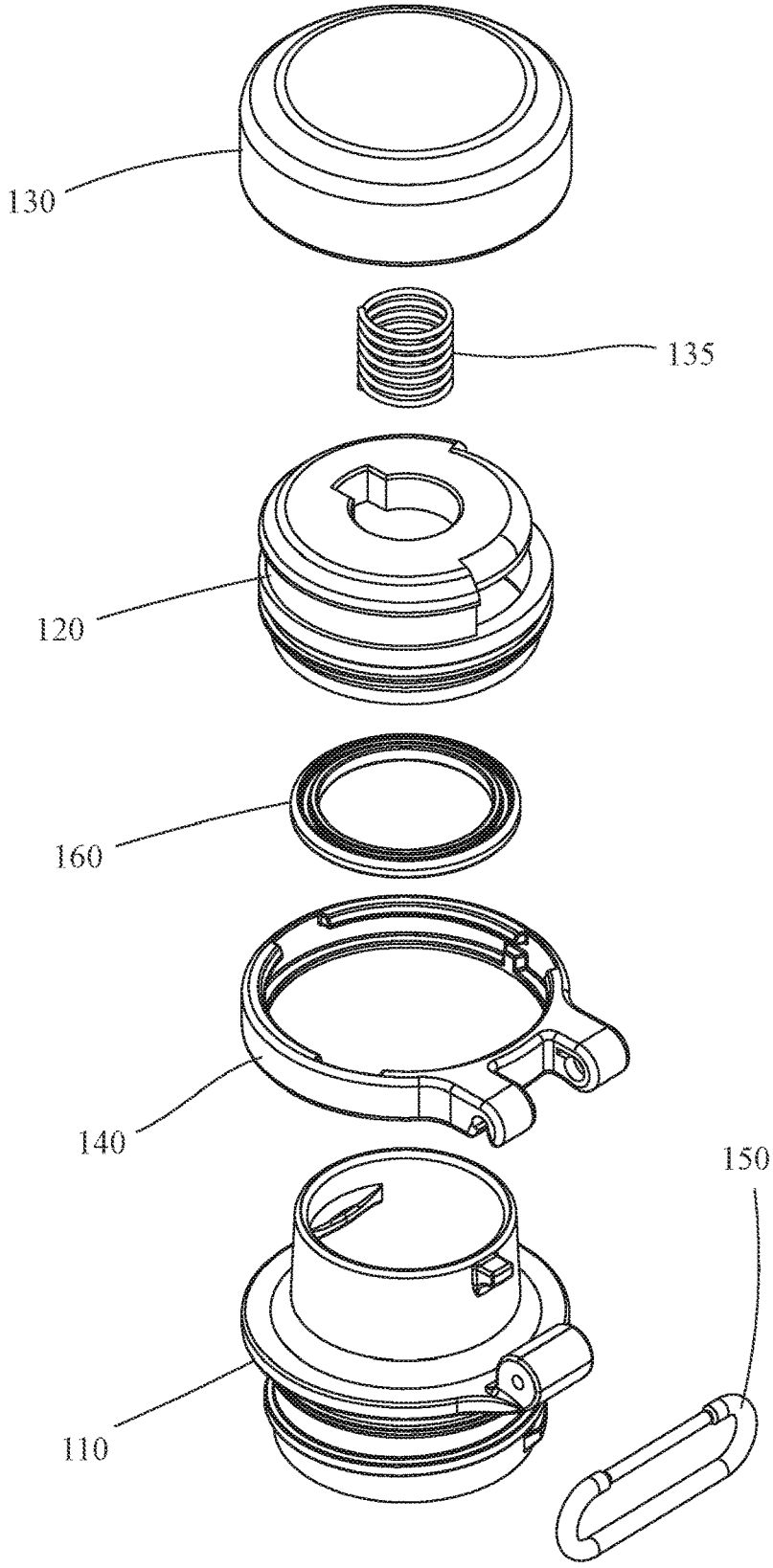
FIG. 2 is an exploded view of the closure assembly in FIG. 1.

Referring now to the drawings, FIG. 1 illustrates a perspective view of a beverage bottle having a closure assembly constructed consistent with the first aspect of the invention. FIG. 2 illustrates an exploded perspective view of the assembly coupled with a bottle opening of the beverage bottle.

The beverage bottle 100 has a bottle body 101 which can be in cylindrical streamline shape or other aesthetic shapes used to hold water, drinks or other beverages for consumption, and a closure assembly 102 coupled to a bottle opening of the bottle body. The closure assembly comprises a lid body 110, a rotary lid 120, a cover 130 and a ring member 140.

Figure 2A:
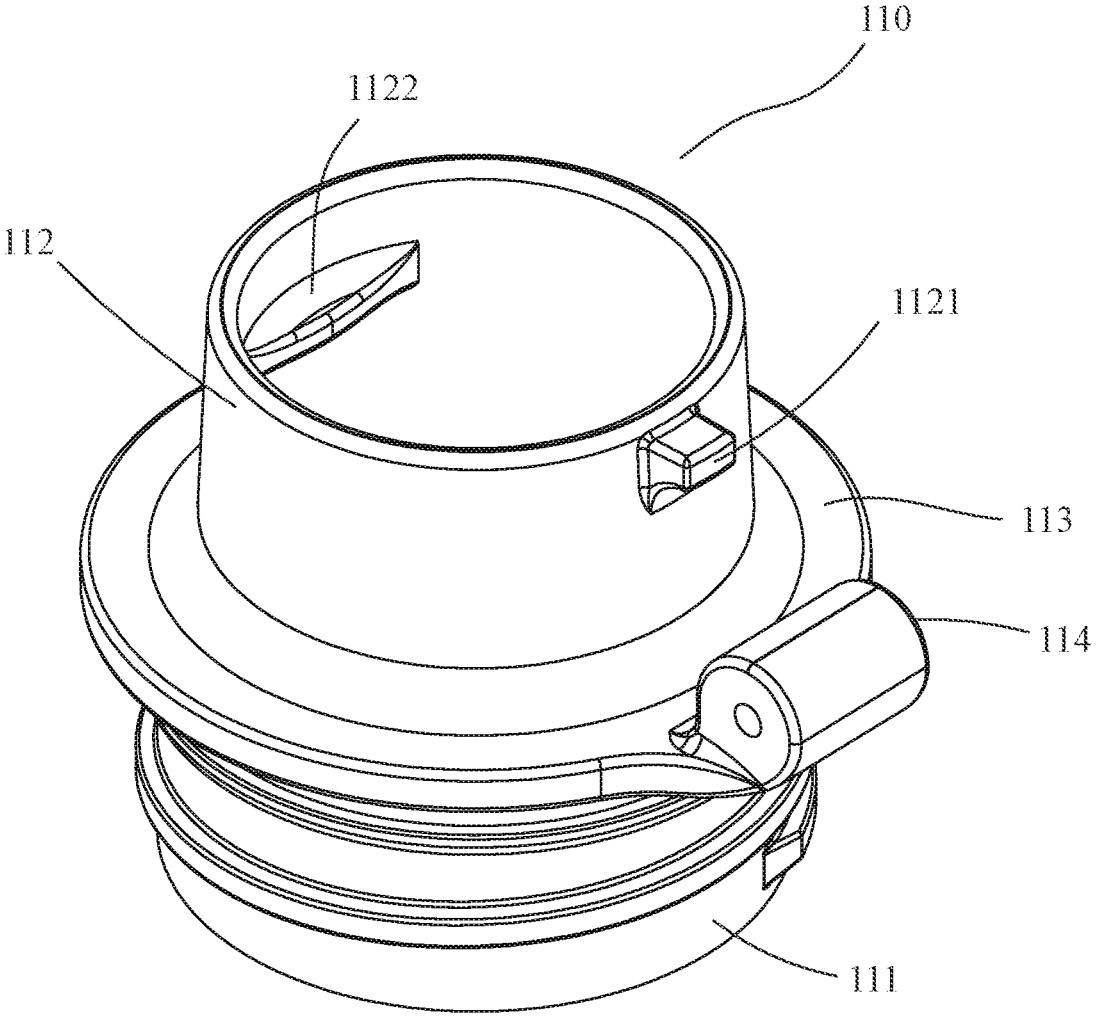
FIG. 2A is a perspective view of the lid body.
Figure 2B:
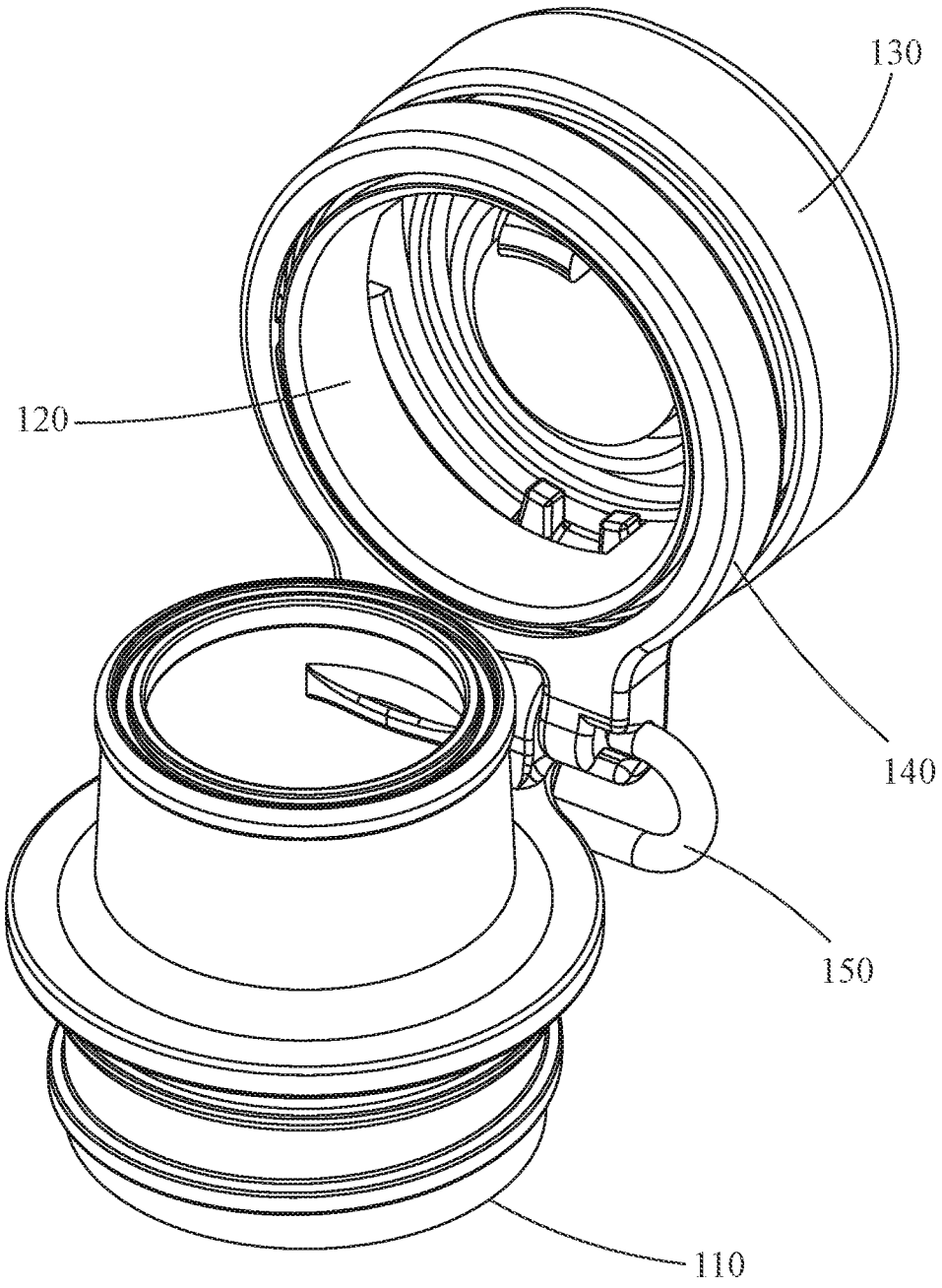
FIG. 2B is a perspective view of the closure assembly in open state.

FIG. 2A illustrates a perspective view of the lid body 110, and FIG. 2B is a perspective view of the assembly in its open position. The lid body 110 has a cylindrical outer shape and comprises a base 111, a neck 112 and a flange 113 formed between the base 111 and the neck 112. The base 111 has a shape and size corresponding to the bottle opening of the bottle body 101, and can be detachably secured on the top of the bottle body 101, for example through threads engagement. The lid body 110 is of hollow structure so that it is in fluid communication with the bottle body for beverage dispensing. At a rim of the flange 113 is a hinge holder 114. The neck 112 is further provided with a rotation stopper 1121 on an outer wall surface thereof and positioned above the hinge holder 114, and with at least one protrusion 1122 on an inner wall surface thereof.

Figure 3A:
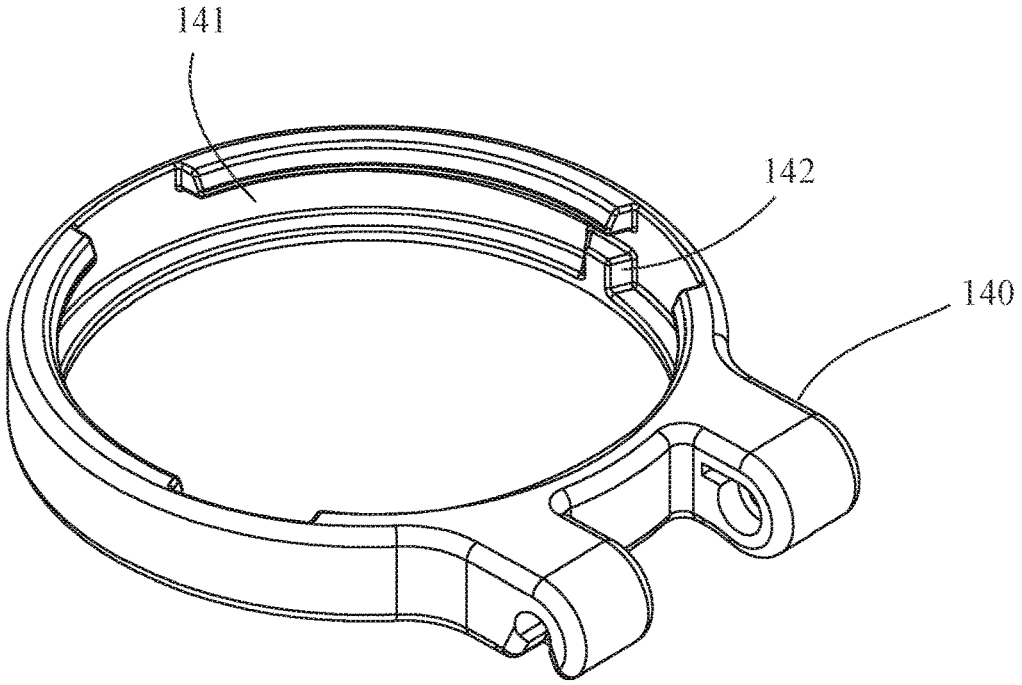
FIG. 3A is a perspective view of the ring member.

As shown in FIG. 2B, the ring member 140 is pivotably mounted on the lid body 110 through a hinge 150 passing through the hinge holder 114 of the lid body 110. The ring member 140 is placed to rest on the flange 113 when the assembly is in the closed position. The ring member 140 defines an inner groove 141 on its inner surface, with a bulge 142 positioned projecting from the inner groove 141 (see FIG. 3A).

Figure 3B:
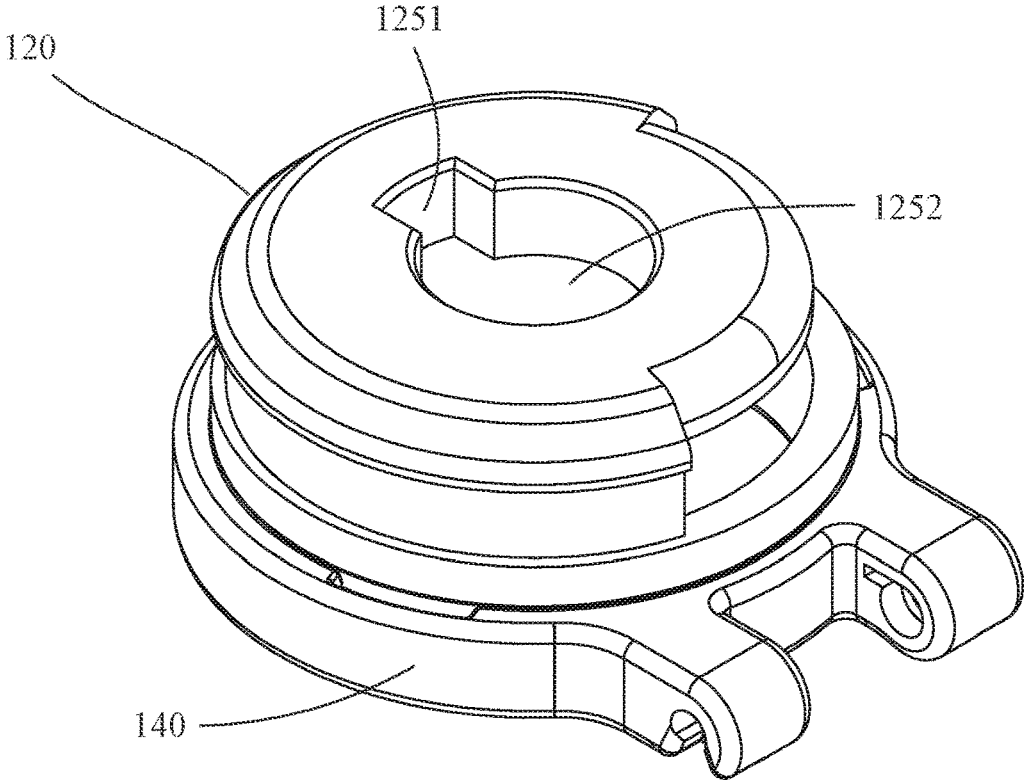
FIG. 3B is a view showing the rotary lid coupled to the ring member.
Figure 4A:
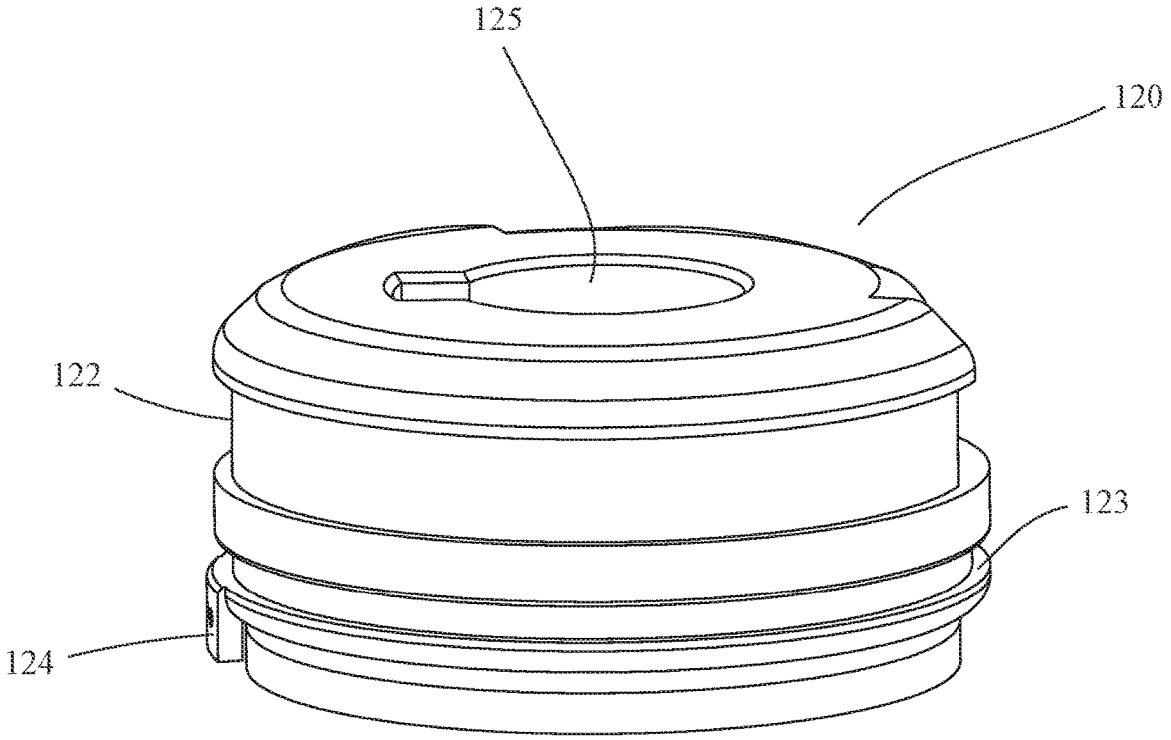
FIGS. 4A-4B are views showing different sides of the rotary lid.
Figure 4B:
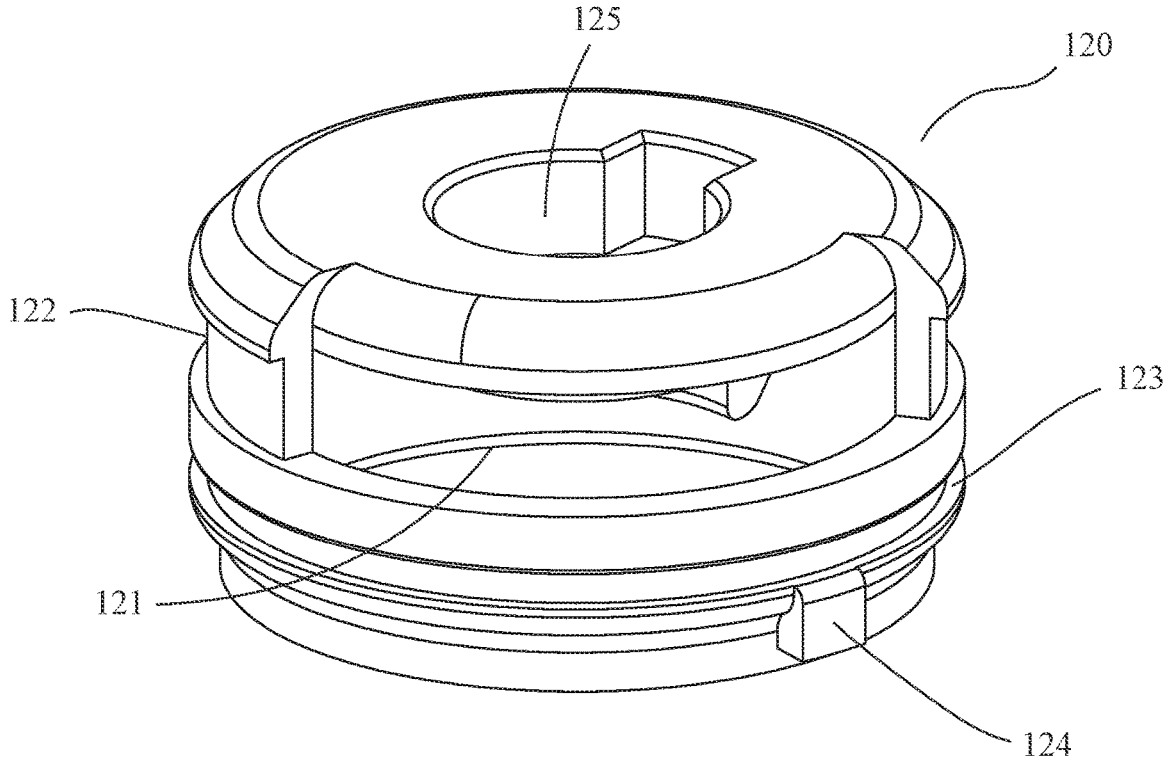
Figure 4C:
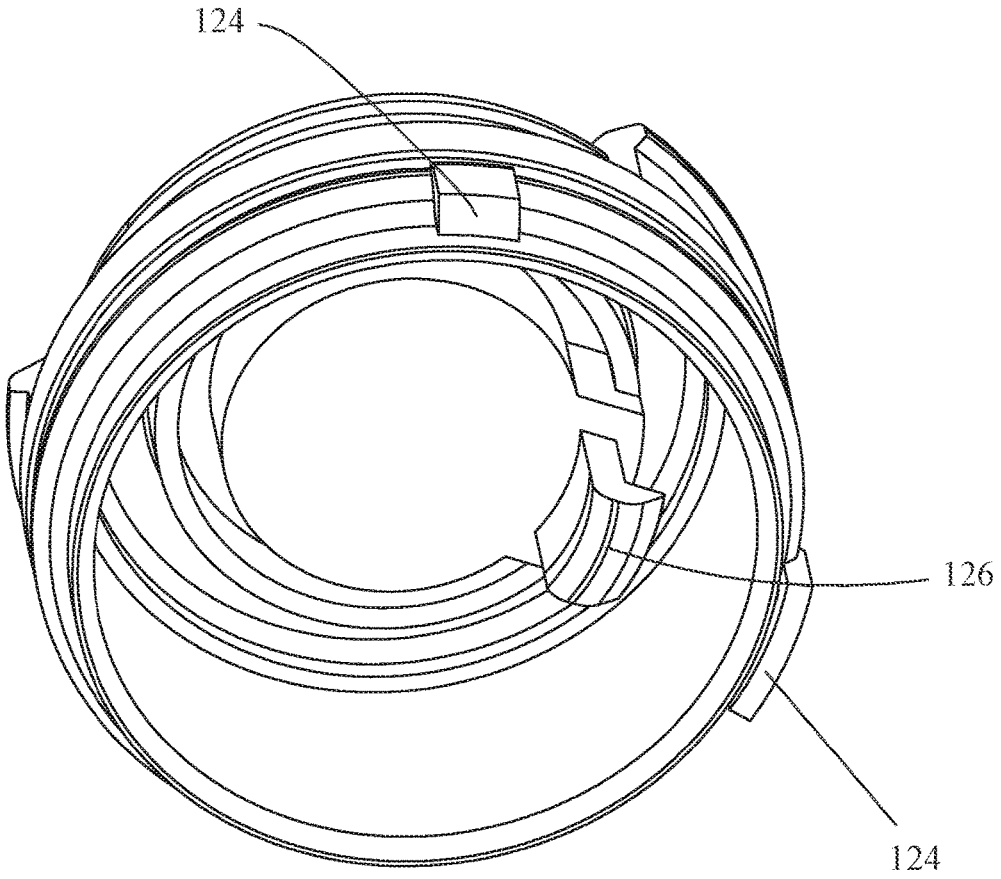
FIG. 4C is a view showing an underside of the rotary lid.
Figure 4D:
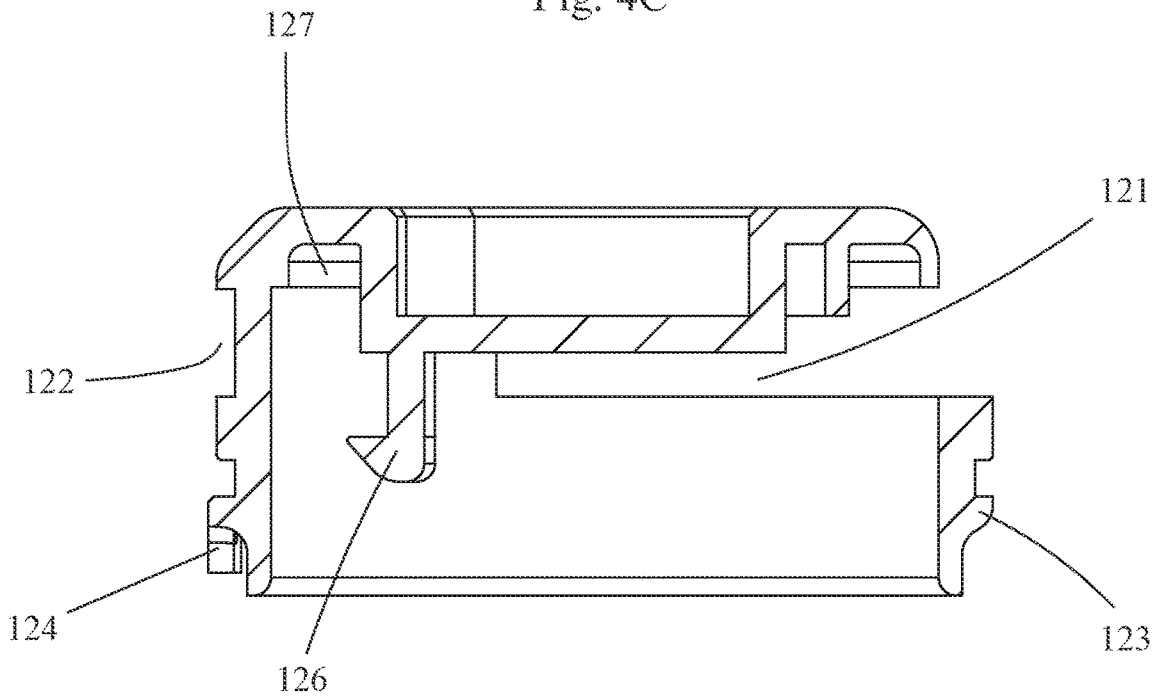
FIG. 4D is a sectioned view of the rotary lid.

The rotary lid 120 is illustrated in FIG. 4A to FIG. 4D. As illustrated, the rotary lid 120 is substantially cylindrical and comprises an arcuate window 121 circumferentially and a C-shaped groove 122. The window 121 and the C-shaped groove 122 forms together a circle. The rotary lid 120 further comprises a circular ridge 123 at its lower part, two spaced apart blocks 124 extending downwardly from the ridge 123. The ridge 123 is configured to engage with the inner groove 141 of the ring member 140 and the blocks 124 are deployed inside the inner groove 141, as shown in FIG. 7A and FIG. 7B. There is a recess 125 on a top surface of the rotary lid 120, and the recess 125 comprises a substantially rectangular portion 1251 and a substantially circular portion 1252 as show in FIG. 3B. However, it shall be understood that the shape of the recess 125 shown in figures is an example only. Now turning to FIG. 4C and FIG. 4D, a hook member 126 extends downwardly from the underside of the recess 125. The hook member 126 is positioned to be engageable with the protrusion 1122 of the lid body 110 when the assembly is in the closed position (see FIG. 6A, FIG. 7A and FIG. 7B), and disengageable from the protrusion 1122 of the lid body 110 when the assembly is in the open position (see FIG. 6B and FIG. 7C).

Figure 5A:
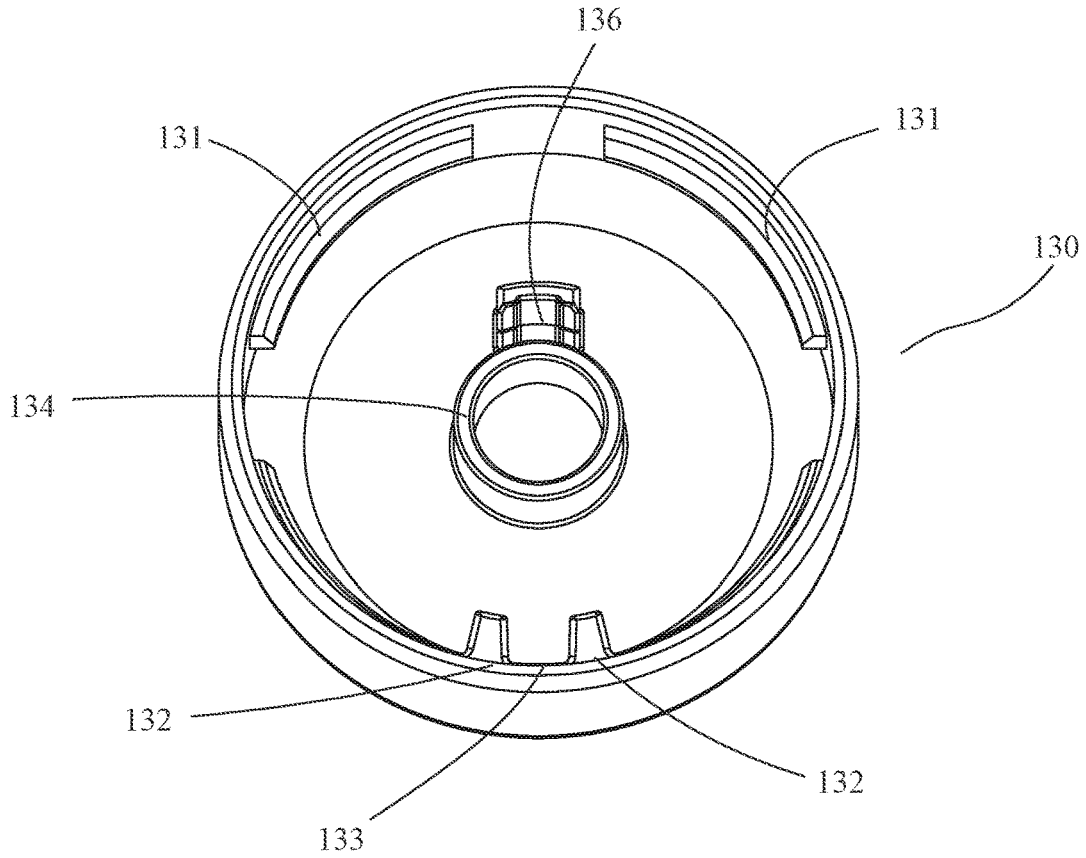
FIGS. 5A-5B are views showing internals of the cover.
Figure 5B:
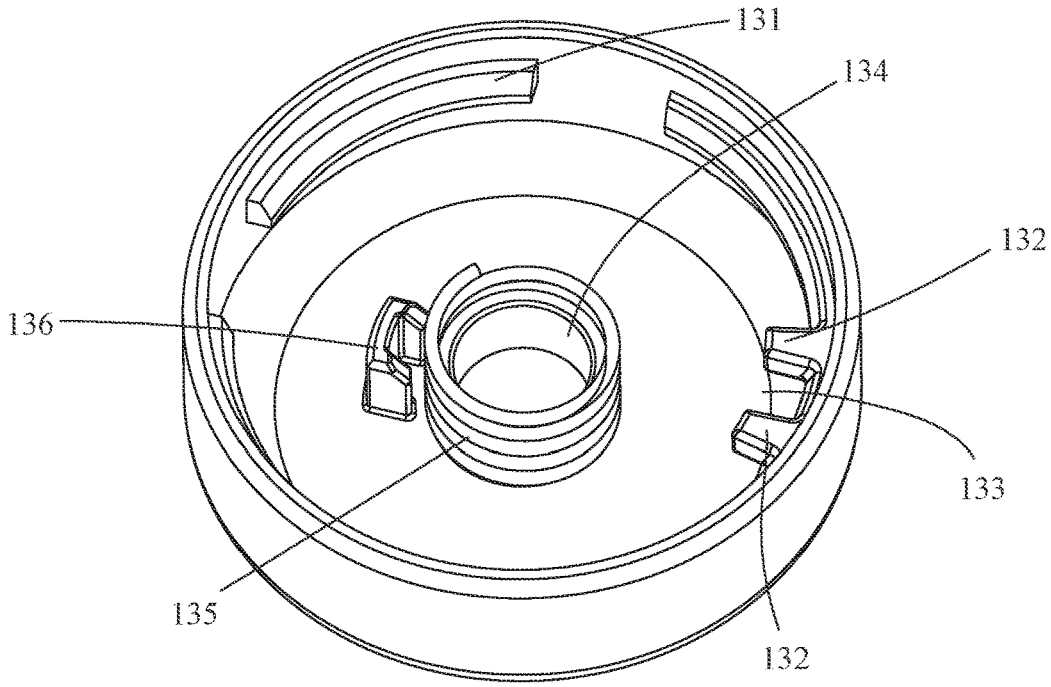

The cover 130 is illustrated in FIG. 5A and FIG. 5B showing the cover 130 has a plurality of lateral extension 131 and a pair of protruding portions 132 with a gap 133 therebetween. The gap 133 is sized and shaped to receive the rotation stopper 1121 formed on the neck 112 of the lid body 110 (see FIG. 8A). The lateral extensions 131 are engageable with the C-shaped groove 122 of the rotary lid 120. The pair of protruding portions 132 is positioned to be rotatable through the arcuate window 121 of the rotary lid 120, which confines the rotary lid 120 to rotate within the movable area defined by the window 121 (see FIG. 8A to FIG. 8D). There is a hub 134 on the center of bottom surface of the cover 130, and the hub 134 is configured as a resilient member holder for holding a resilient member 135. The resilient member 135, for example a spring, is provided to allow for pressing the cover 130 downwardly and bias the cover 130 to bounce upwardly after the pressure is released from the cover 130. A tab 136 is arranged adjacent to the hub 134. The tab 136 is snugly received in the rectangular portion 1251 of the recess 125, and the hub 136 together with the resilient member 135 are received in the circular portion 1252 of the recess 125. Thereby the cover 130 and the rotary lid 120 are firmly connected together and have to rotate together further with the aid of the engagement of the lateral extensions 131 with the C-shaped groove 122 of the rotary lid 120.

Figure 6A:
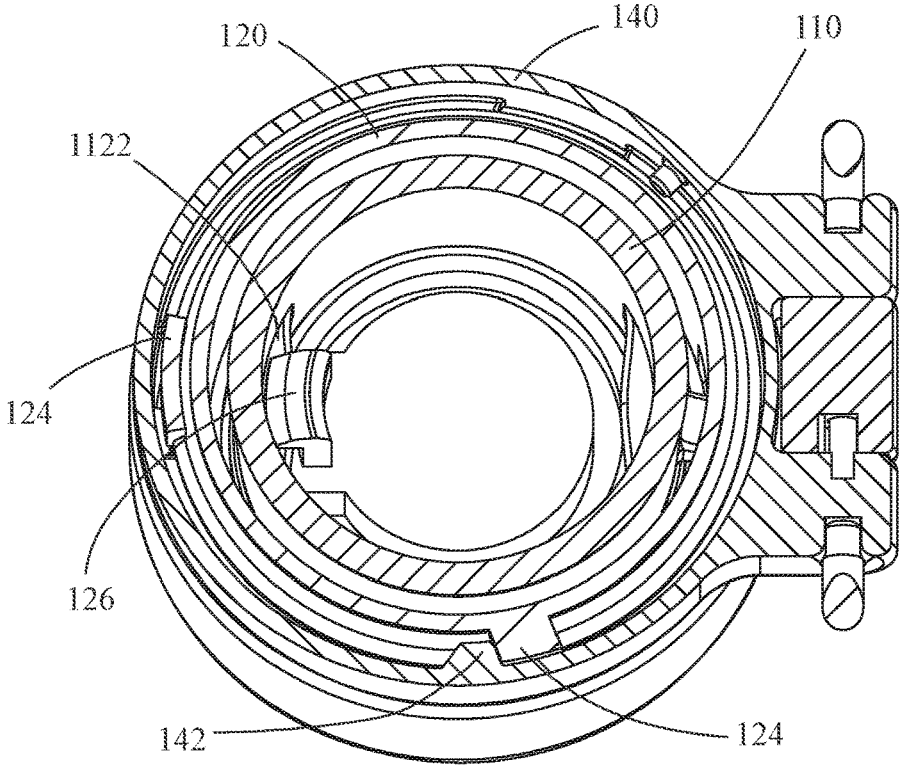
FIGS. 6A-6B are views showing rotational positions of the rotary lid with respect to the ring member.
Figure 6B:
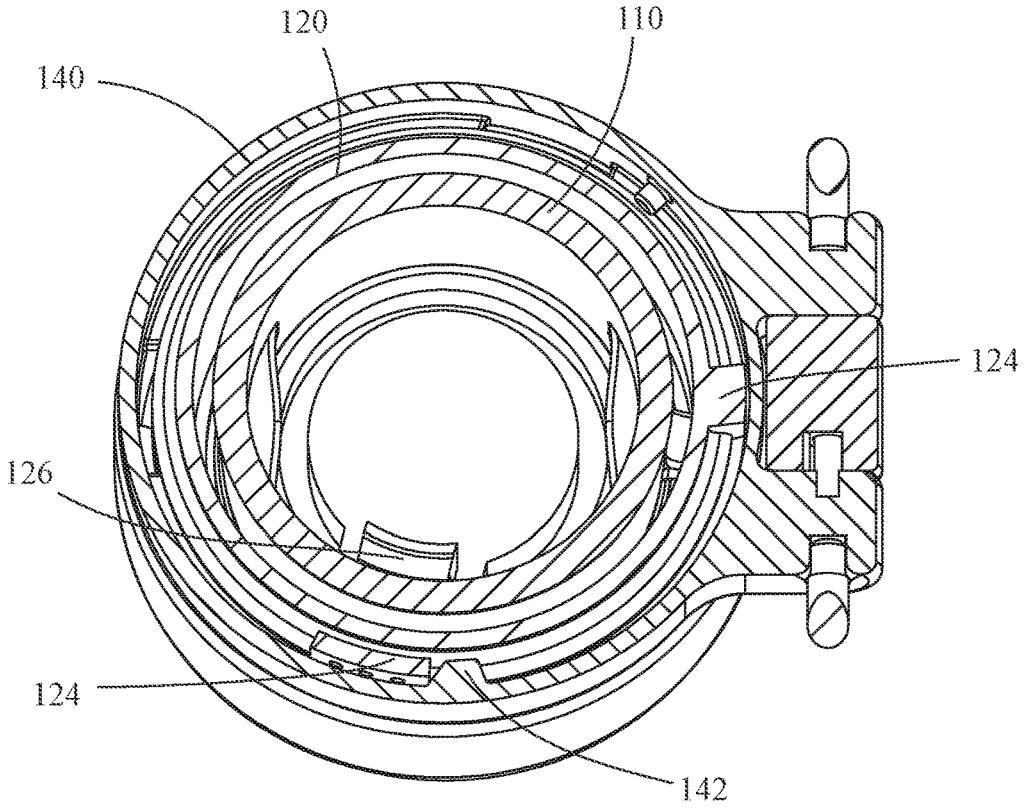
Figure 7A:
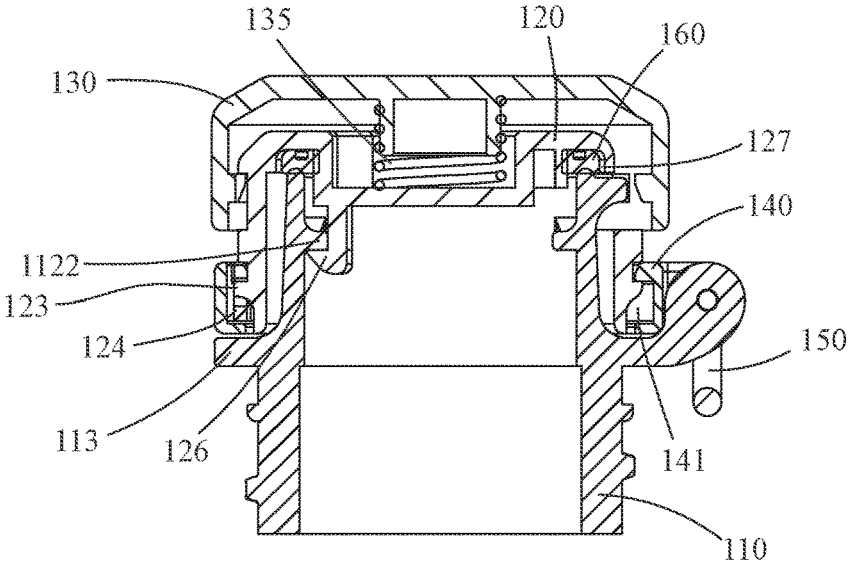
FIGS. 7A-7C are sectioned views showing the transitional movements of the cover and the rotary lid.
Figure 7B:
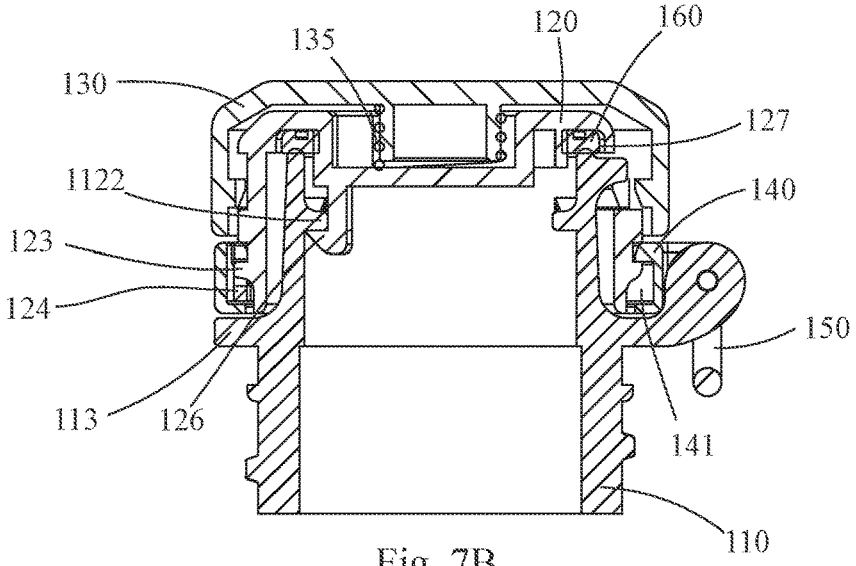
Figure 7C:
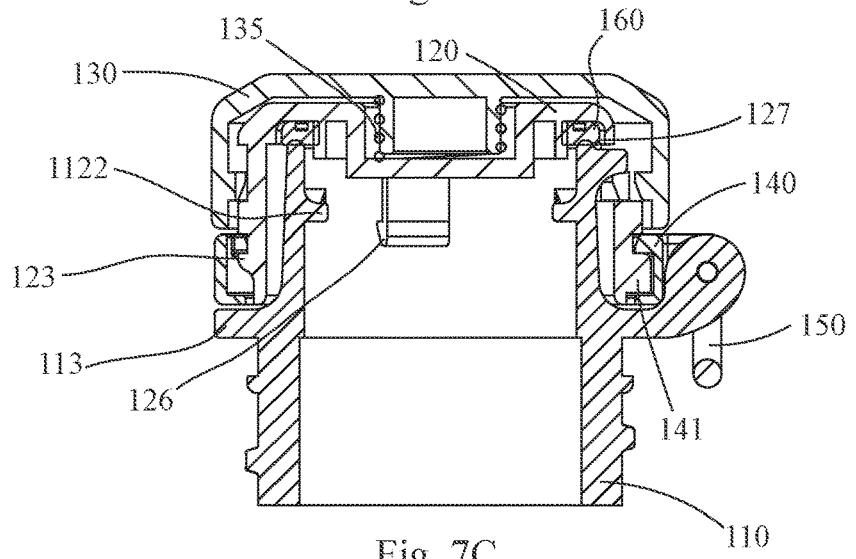

FIG. 6A and FIG. 6B are respectively perspective bottom views of the assembly in the closed position and in the open position. FIG. 7A to FIG. 7C illustrate the assembly in different positions in cross-section; and FIG. 8A to FIG. 8D illustrate the rotation stopper and the protruding portions 132 when the assembly are in different positions.

Figure 8A:
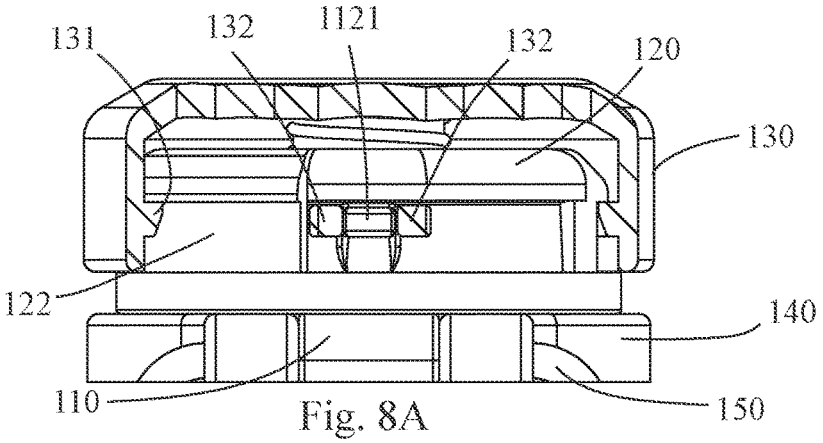
FIGS. 8A-8D are cutaway views showing the transitional movements of the cover and the rotary lid.
Figure 8B:
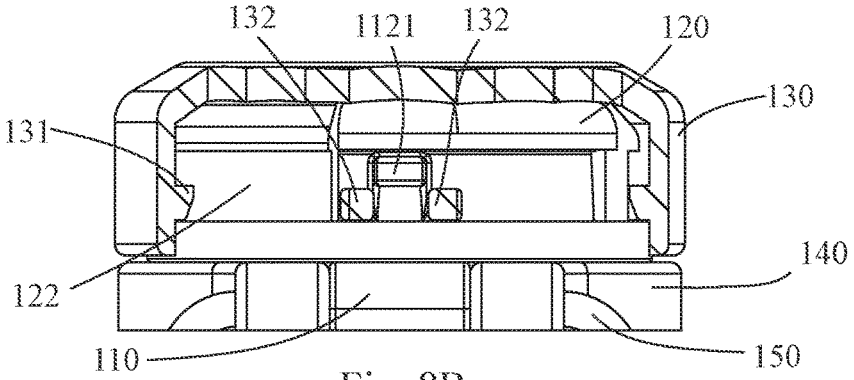
Figure 8C:
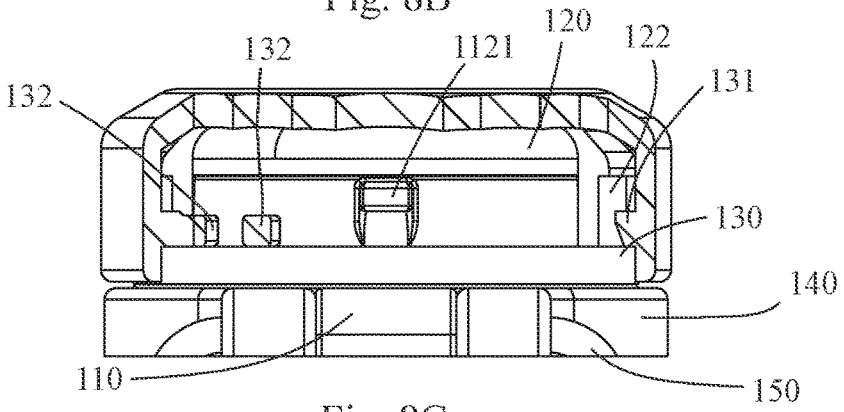

FIG. 8A illustrates the assembly in the fully closed position wherein the rotation stopper 1121 is located between the two protruding portions 132 so that the rotary lid 120 together with the cover 130 is locked and prevented from rotation. In this position, the hook member 126 is engaged with the protrusion 1122 so as to lock the rotary lid 120 and the cover 130 to the lid body 110 (see FIG. 7A). When the cover 130 is pressed down to cause the two protruding portions 132 to move down, the rotation stopper 1121 is not located in the rotation path of the rotary lid 120 to allow rotation of the rotary lid 120 which in turn drives the cover 130 to rotate. The rotation of the rotary lid 120 also results in disengagement of the hook member 126 from the protrusion 1122 (see FIG. 7C). The C-shaped groove 122 of the rotary lid 120 has a groove height for allowing vertical displacement of the lateral extensions 131 within the groove 122 along with the downward movement of the cover 130 when it is pressed.

Figure 8D:
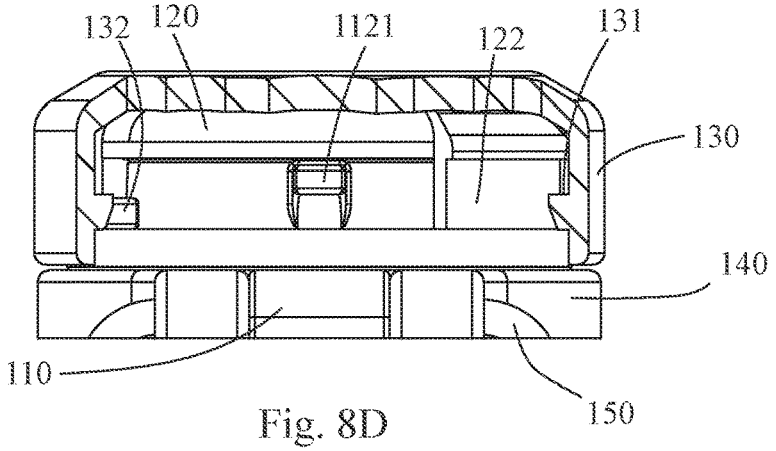

The rotary lid 120 is rotated until the block 124 comes into contact with the bulge 142 of the ring member 140 and therefore is stopped by the bulge 142 as shown in FIG. 6B. Because the hook member 126 of the rotary lid 120 is not engaged with the protrusion 1122 of the lid body 110, the combination of the cover 130, the rotary lid 120 and the ring member 140 are allowed to pivot upwardly with respect to the lid body 110 as shown in FIG. 2B to expose the open top of the lid body and thus the opening of the bottle body 101. FIG. 7C and FIG. 8D illustrate the assembly in a state ready for pivoting upwardly. In this way, the assembly 102 is opened via the press and turn actions.

In order to provide a buffer for the rotary lid 120, a buffer ring 160 is received in a channel 127 of the rotary lid 120 and in abutment with a top of the neck 112 of the lid body 110, as shown in FIG. 7A to FIG. 7C.

Figure 9A:
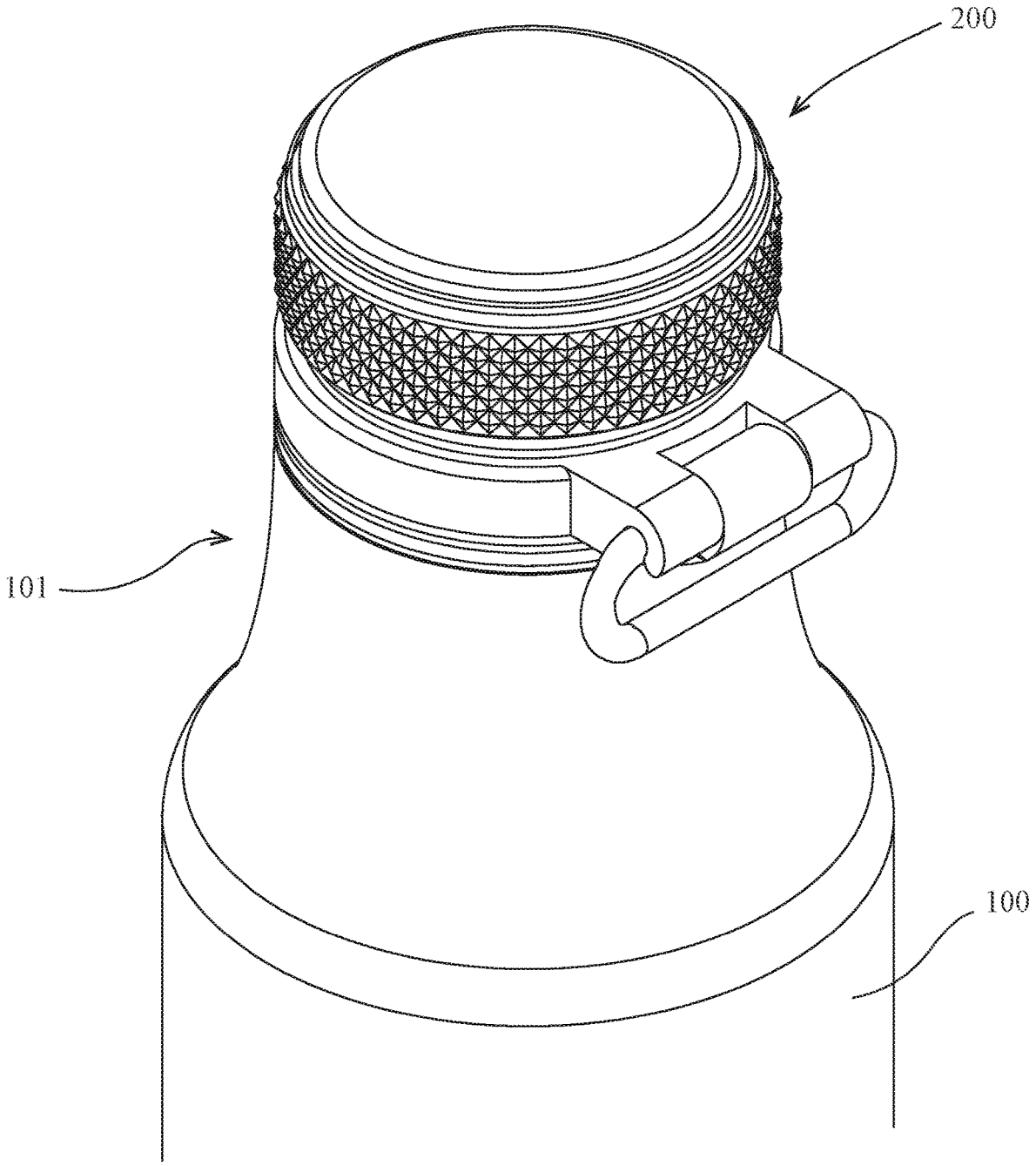
FIG. 9A is a perspective view of a container fitted with a closure assembly according to a second embodiment of the present invention.
Figure 9B:
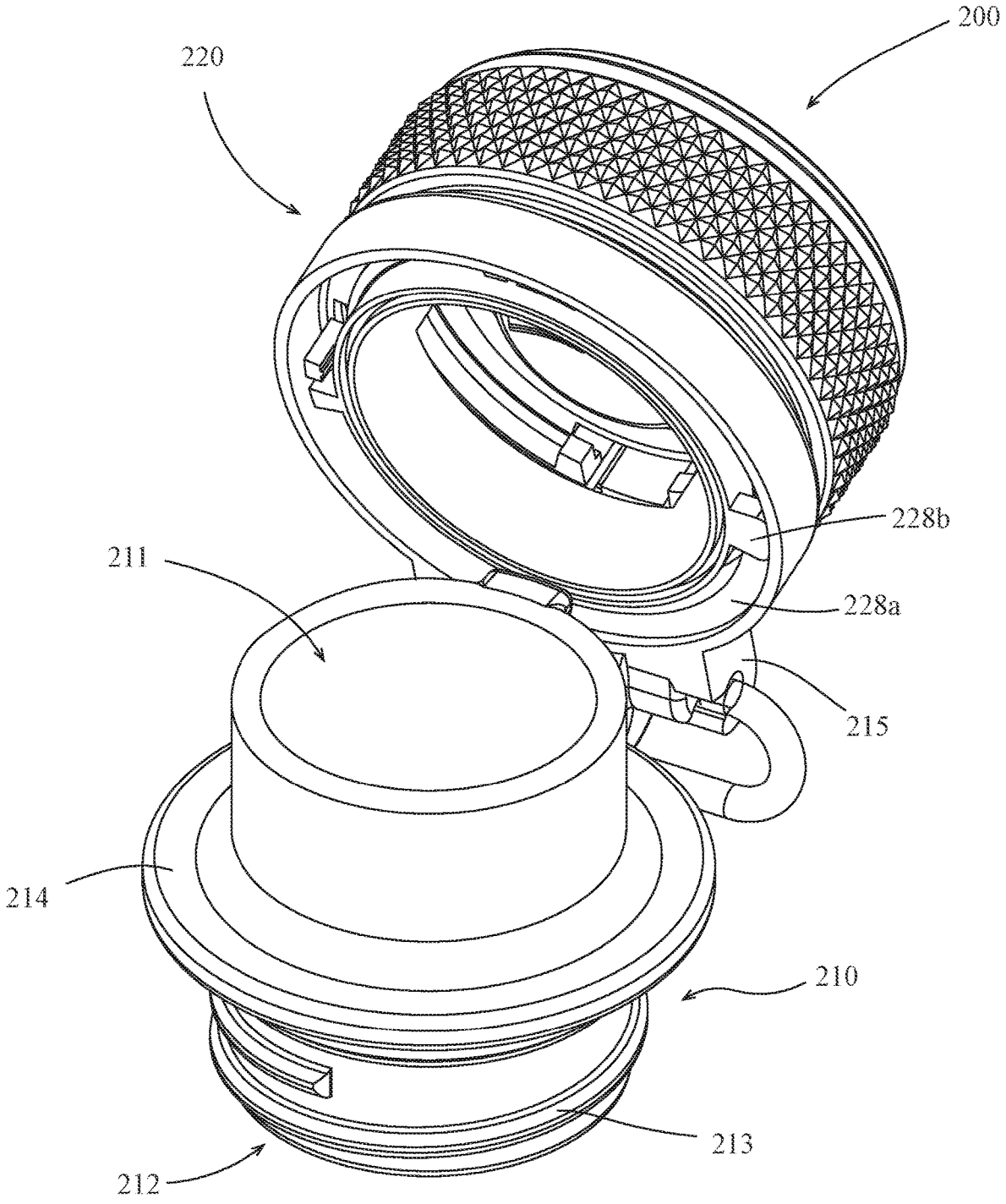
FIG. 9B is a perspective view showing the closure assembly in open state.
Figure 10:
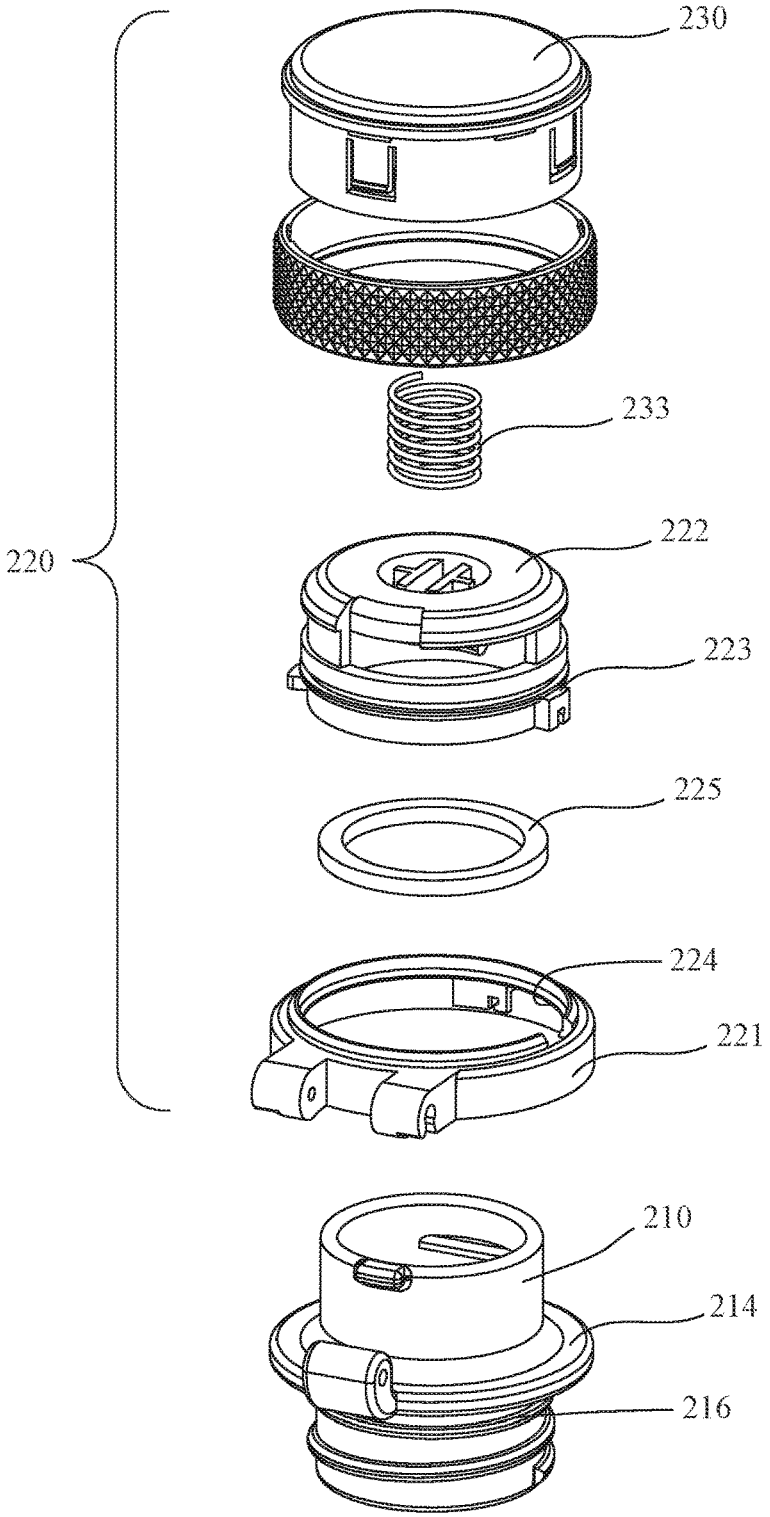
FIG. 10 an exploded view of the closure assembly in FIG. 9A.

FIG. 9A and onwards depict an alternative embodiment of the closure assembly 200, representing a second aspect of the present invention. Similarly, this particular closure assembly is designed for use with beverage containers, i.e., cylindrical bottles. When coupled with a bottle 100, as shown in FIG. 9A and FIG. 9B, the closure assembly 200 serves as a resealable closure arrangement. With the closure assembly 200 being closed, the role of the closure assembly 200 is to provide an effective, preferably airtight seal for the bottle 100. Referring to FIG. 9B and FIG. 10, the closure assembly 200 includes a coupling member 210 and a lid assembly 220 connecting to the coupling member 210. The lid assembly 220 forms a resealable closure for an opening 101 of the bottle 100. The coupling member 210 has an outlet end 211 and a coupling end 212 that is shaped and formed for detachably coupling with the opening 101 of the bottle 100 through complementary threads 213. Nevertheless, alternative methods of detachable coupling may also be employed to achieve a secure, sealed connection. A flange portion 214 is provided on the coupling member 210 in-between the outlet end 211 and the coupling end 212, providing support for a hinge arrangement 215 which pivotally connecting to the lid assembly 220. Moreover, situated below the flange portion 214 is a gasket 216 for facilitating a seal between the opening 101 and the coupling member 210. Tightening of the coupling member 210 to the bottle would exert a pressure on the gasket 216 which facilitates sealing.

The lid assembly 220 is configured as a closure component pivotally connected to the coupling member 210. The lid assembly 220 includes a support member 221 and a closure member 222, the latter being rotationally supported by the support member 221. A lower annular slot 223 is formed circumferentially on the closure member 222, and is positioned for engagement with an annular rib 224 provided on the support member 221. A chamfered edge may be provided on the rib to facilitate assembly. The foregoing arrangement allows for the closure member 222 to be rotatable relative to the support member 221. Preferably, the support member 221 is connected to the coupling member 210 via the hinge arrangement 215 situated on its circumferential side. Meanwhile, the closure member 222 is constructed in the form of a cap, enabling it to engage with the outlet end 211 of the coupling member 210 to form a closure thereof. The interior of the closure member 222 is shaped to be complementary with the outlet end 211. To enhance the sealing effectiveness, another gasket 225 is incorporated within the closure member 222 to facilitate sealing of the outlet 211.

The closure assembly 200 is further provided with a locking mechanism configured for selectively maintaining the closure engagement between the closure member 222 and the coupling member 210, and allowing disengagement of the closure engagement. Through the locking mechanism, the closure member 222 is rotatable between two positions: a first position or locked position, where the closure member 222 is locked and effectively seals the outlet 211, and a second position or unlocked position, where the closure member 222 is unlocked and allowed to be disengaged from the outlet 211. Further details of the mechanical arrangement of the locking mechanism will be discussed in the subsequent sections.

Figure 12A:
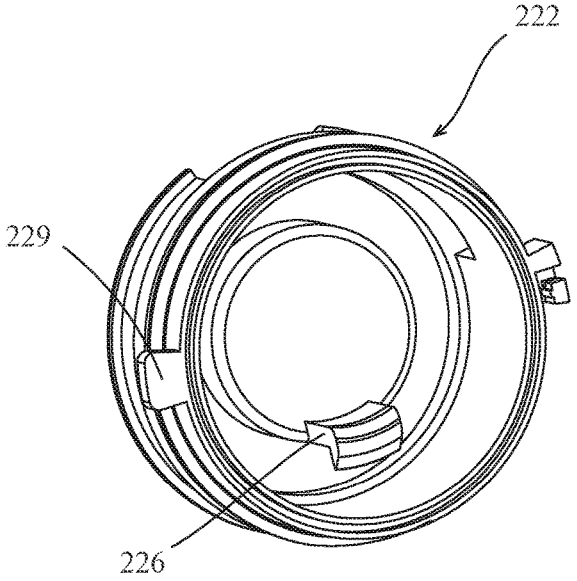
FIG. 12A is a view showing the interior of the closure member.
Figure 12B:
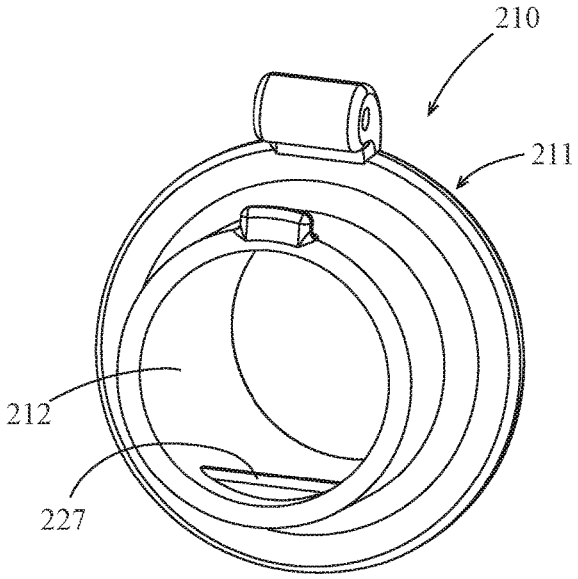
FIG. 12B is a view showing the outlet end of the coupling member.
Figure 13A:
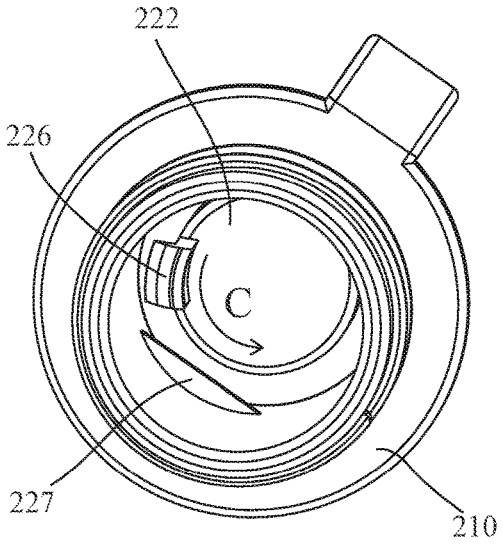
FIG. 13A and FIG. 13B are views showing the transitional movements of the locking mechanism.
Figure 13B:
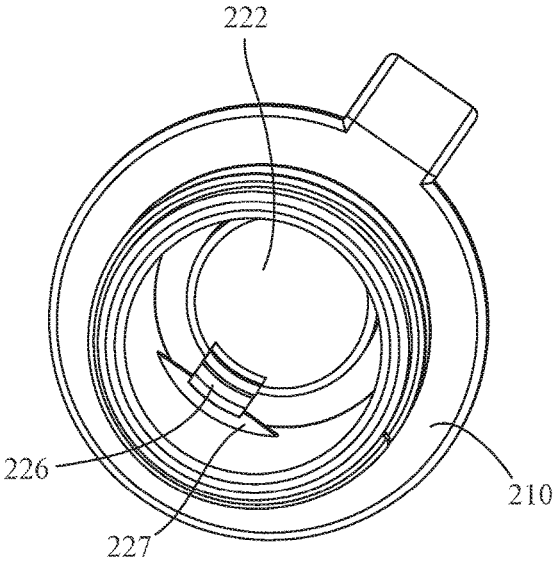

The locking mechanism accomplishes locking of the closure member 222 by means of a retention member 226 formed on the closure member 222. Preferably, the retention member 226 is integrally formed on the closure member 222. Referring to FIG. 12A and FIG. 12B, the retention member 226 is formed and positioned to engage with a corresponding lock protrusion 227 situated within the coupling member 210. The retention member 226 may be configured as a detent extending into the outlet 211, while the lock protrusion 227 may be formed as a rib located within the outlet 211. Preferably, the lock protrusion 227 is located diametrically opposing the hinge arrangement 215. During the closure engagement process, as illustrated in FIG. 13A and FIG. 13B, the detent 226 slides towards the rib 227 along a circumferential direction C within the outlet. Crucially, the rib 227 acts as a barrier, preventing the detent 226 from passing beyond itself in the axial direction, thereby maintaining the closure engagement. This mechanical interaction occurs during the rotational movement of the closure member 222 which operatively transitions the closure member 222 along with the retention member, between the first and second positions, and vice versa.

To enhance ease of operation of the closure assembly 200, it may be preferable to limit the rotational movement of the closure member 222 relative to the support member 221. This constraint in movement serves the crucial purpose of delineating both the first and second positions. Notably, as shown in FIG. 9B, the support member 221 is provided with a stopper 228*a* positioned to operatively abut against a baffle 228*b* provided on the closure member 222, whether the closure member 222 is in the first or the second position. This deliberate arrangement effectively limits the rotational range of closure member 222, preventing it from exceeding the first and second positions, as specifically limited by the stopper 228*a*. In a preferred embodiment, the closure member 222 may be configured to be biased toward the first or locked position by a first resilient member 229 (shown only in FIGS. 15C, 16 and 17C), such as a tension spring. The first resilient member 229 may be securely affixed between the closure member 222 and the support member 221, and configured to undergo elongation when the closure member 222 rotates toward to the second or unlocked position. Utilizing the first resilient member 229 to impart bias to the closure member 222 in the locked position offers the advantage of preserving the closure engagement. This, in turn, effectively safeguards against accidental spillage of contents during handling or movement. More advantageously, the first resilient member 229 assists the closure member 222 rotating between the locked and unlocked position.

Preferably, the closure assembly 200 is provided with an actuating mechanism configured to offer users selective control over the rotation of the closure member 222. This control is facilitated through the inclusion of an actuator 230. The primary function of the actuating mechanism is to create a barrier that effectively isolates the closure member 222 from direct manipulation by the user. Preferably, as shown in FIG. 9A and FIG. 9B, the actuator 230 is constructed in a manner that substantially conceals the closure member 222, rendering it inaccessible to the user directly. For optimal functionality, the actuator 230 may be preferably configured as a cap that at least partially encapsulates the closure member 222.

Figure 11:
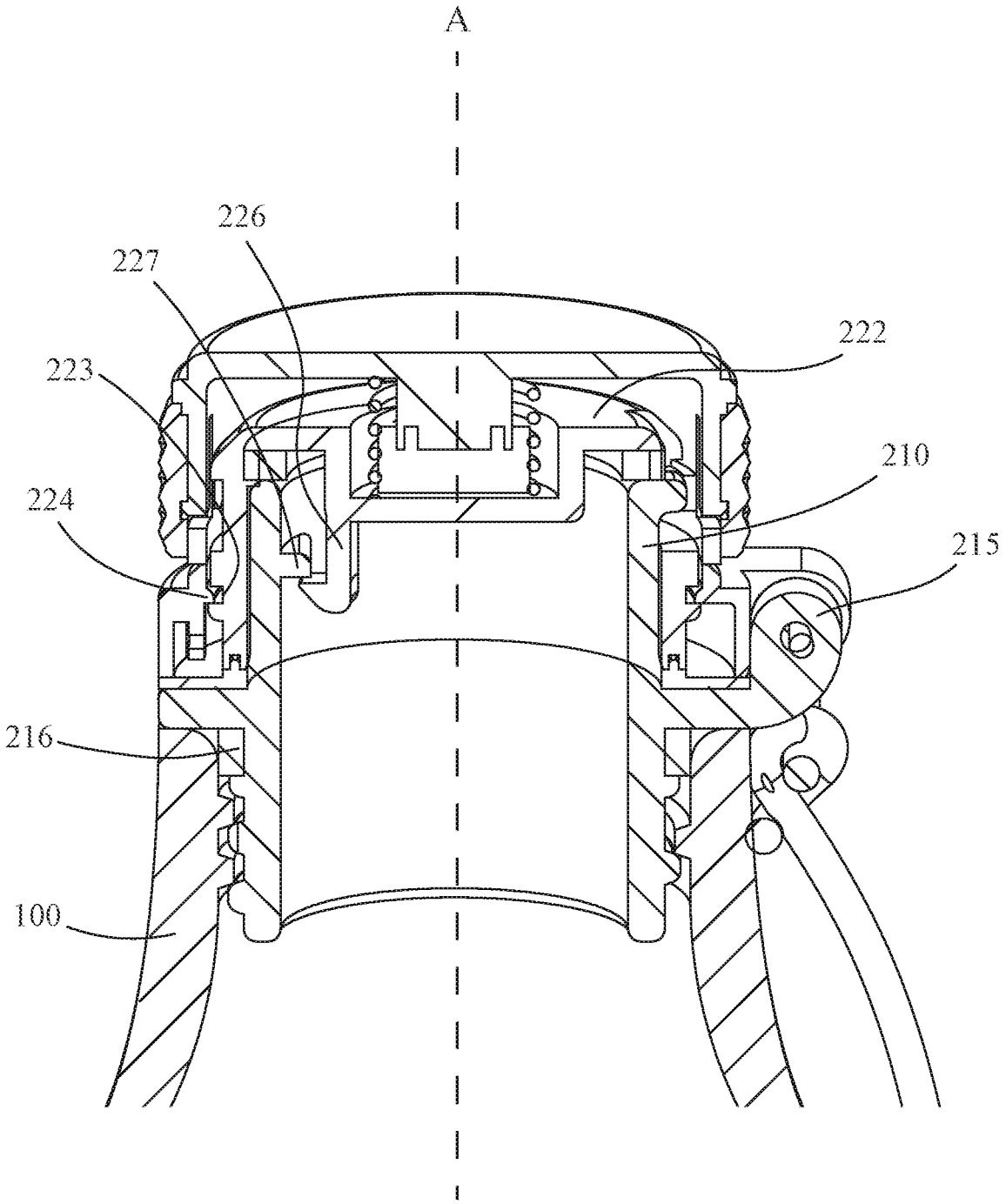
FIG. 11 is a sectioned view showing the closure assembly in FIG. 9A.
Figure 14:
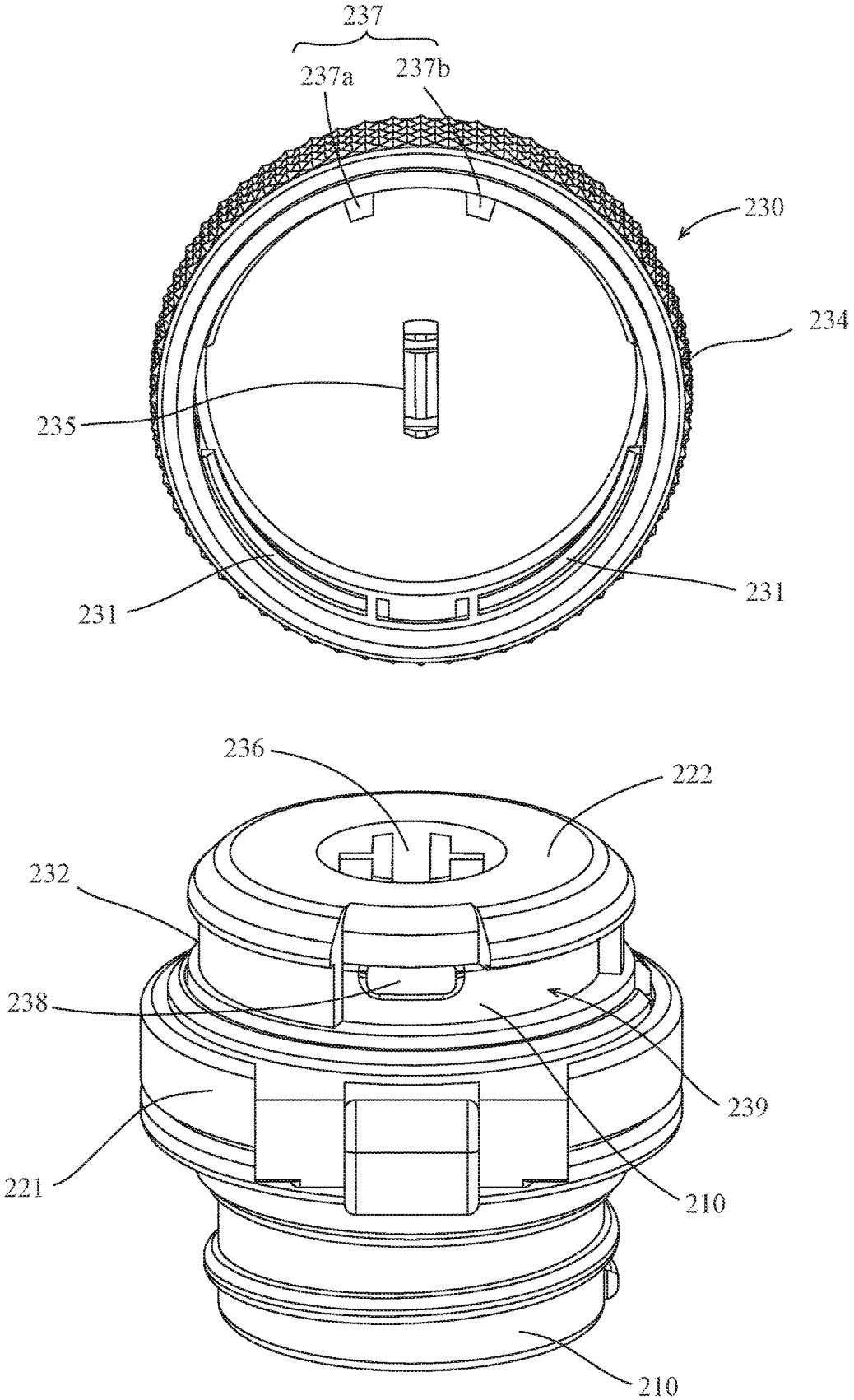
FIG. 14 is a view showing the actuator and the closure member.

As illustrated in FIG. 14, the interior of the actuator 230 is formed with one or more arcuate protrusions 231 for engagement with an upper annular slot 232 disposed on the peripheral side of the closure member 222. This configuration ensures that the actuator 230 is supported in a manner that allows rotational movement, facilitated by its engagement with the closure member 222. Preferably, a chamfered edge may be provided on each of the arcuate protrusions to facilitate said engagement. Notably, the upper annular slot 232 has a greater width than that of the one or more arcuate protrusions 231, allowing for vertical or axial movement of the actuator 230 with respect to the closure member 222. The above arrangement permits the actuator 230 to move in an axial direction along axis A (see FIG. 11), between a de-actuated position and an actuated position. The actuated position is where the actuator 230 is pressed downward toward the closure member 222. To enhance ease of operation, the actuator 230 is biased towards the de-actuated position by a second resilient member 233, for example, a compression spring, provided between the closure member 222 and the actuator 230. Preferably, a gripping portion 234 may be provided on the actuator 230 for facilitating rotation thereof. The gripping portion 234 with a texturized surface may be integrally formed with the actuator 230, or provided as a separate part affixable thereto, as shown in FIG. 10.

When the actuator 230 is in the actuated position, its primary role is to facilitate the rotation of the closure member 222. As illustrated in FIG. 14, the actuator 230 is formed with a drive protrusion 235 which may be shaped as a rectangular block. The drive protrusion 235 effectively enables the imparted rotation of the closure member 222 upon engagement with a corresponding drive slot 236 on the closure member 222. Conversely, when the actuator 230 remains in the de-actuated position, the drive protrusion 235 disengages from the drive slot 236. Constrained by the actuating mechanism, the actuator 230 is configured to remain immobile and essentially locked in place, preventing unintentional rotation while in the de-actuated position.

Specifically, the actuator 230 incorporates a lock catch 237 positioned on its inner wall, extending radially toward its axial centre. In the de-actuated position of the actuator 230, the lock catch 237 aligns to engage with a lock tongue 238 situated on the outer wall of the coupling member 210. The engagement between the lock catch 237 and the lock tongue 238 effectively restrains the actuator 230 from rotating in relation to the coupling member 210, thereby maintaining the closure member 222 in the locked position. Notably, the lock catch 237 is embodied as a pair of spaced-apart projections 237*a*, 237*b*. When the actuator 230 is coupled to the closure member 222, the pair of projections

237*a*, 237*b* extends through an open slot 239 within the upper annular slot 232 of the closure member 222 to access the lock tongue 238 on the coupling member. The open slot 239 has a defined length that permits a predetermined amount of movement by the lock catch 237, simultaneously limiting the extent of rotation exhibited by the actuator 230. As the actuator 230 undergoes both axial and rotational motions, the lock catch 237 moves within the open slot 239 both axially and circumferentially with respect to the closure member 222.

FIG. 15*a* to FIG. 17*d* progressively demonstrate the operation of the actuation mechanism, transitioning the closure member from a first or locked position to a second or unlocked position. Beginning with FIG. 15*a* through FIG. 15*d*, these figures present various orthogonal views of the closure assembly 200 with the lid assembly locked in its closed position. To facilitate clarity in these illustrations, certain sections of the circumferential wall of the actuator 230 and the outer wall of the support member 221 have been omitted for visual purposes.

Figure 15A:
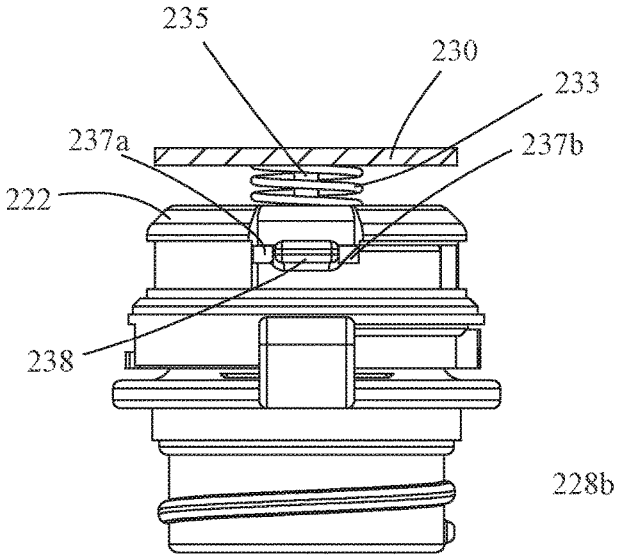
FIGS. 15A-15D are views showing orthogonal views of the closure assembly, with the actuator in the de-actuated position.
Figure 15B:
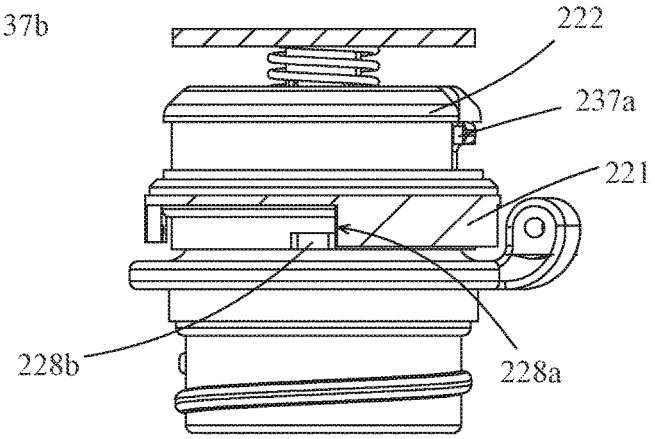
Figure 15C:
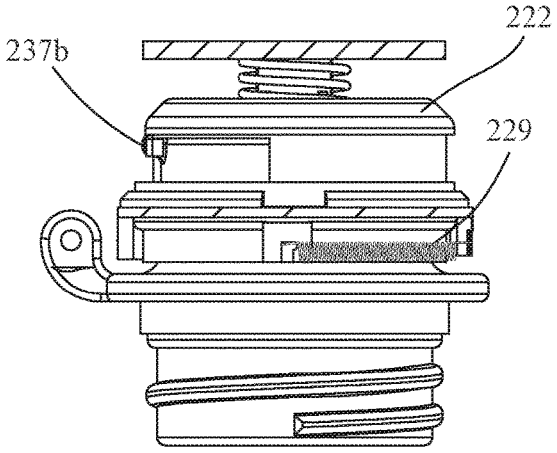
Figure 15D:
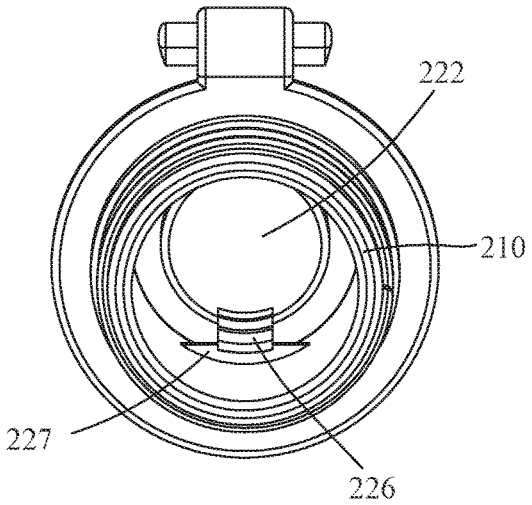

FIG. 15*a* depicts the actuator 230 in the de-actuated position, where the pair of projections 237*a*, 237*b* are engaged with the lock tongue 238, effectively immobilizing the actuator 230 from rotation. In FIG. 15*b*, a right-side view of FIG. 15*a*, the stopper 228*a* of the support member 221 is shown abutting against a baffle 228*b* of the closure member 222. This contact prevents the closure member 222 from rotating beyond a certain point. FIG. 15*c*, a left-side view of FIG. 15*a*, provides a glimpse of the first resilient member 229, typically a tension spring, in its default length. The tension spring 229 may be preloaded to impart a biasing force that urges the closure member 222 to remain in the locked position. Lastly, in FIG. 15*d*, a bottom view of FIG. 15*a*, illustrating the locking mechanism in its locked state, with the detent 226 and the rib 227 in full engagement.

Figure 16:
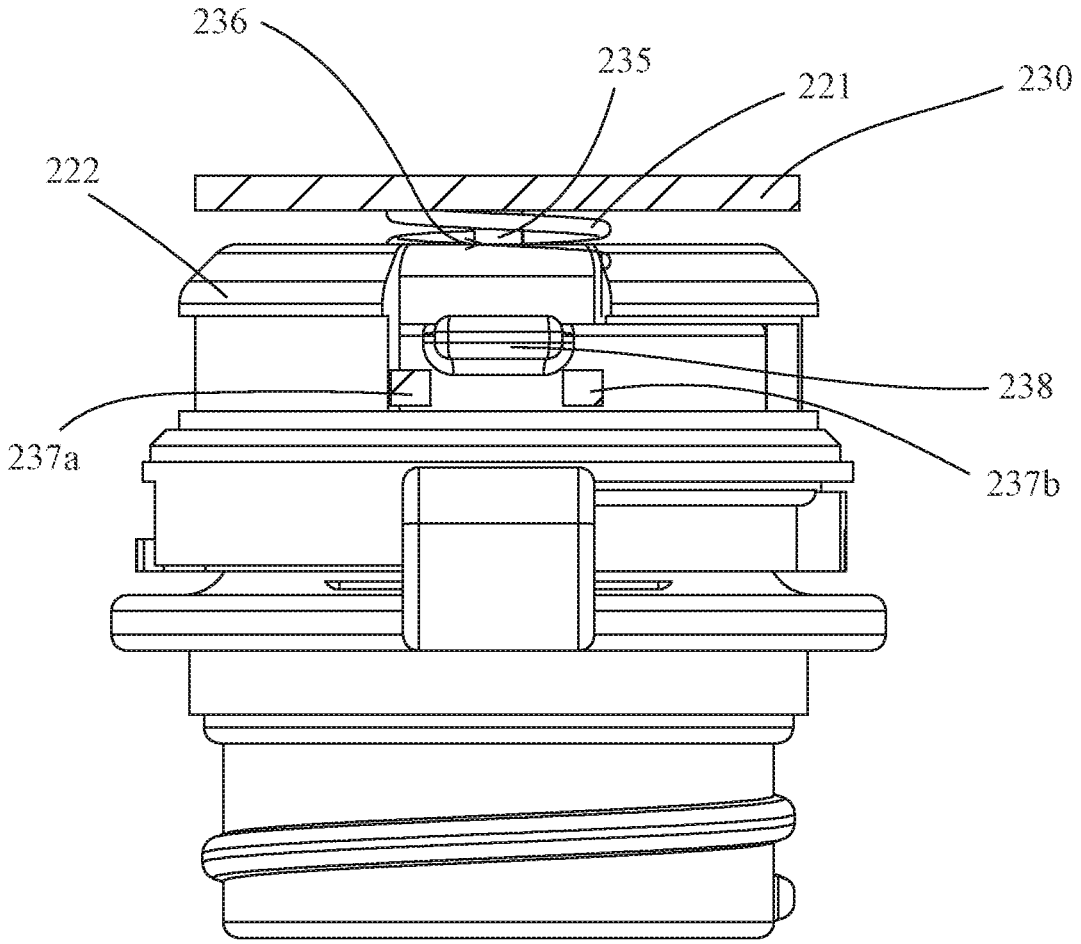
FIG. 16 is a view showing the closure assembly with the actuator in the actuated position.

FIG. 16 illustrates the actuator 230 is transitioned to the actuated position, of which is pressed downward. As shown, the drive protrusion 235 is engaged with the drive slot 236 on the closure member 222, establishing a drivable connection. Simultaneously, the pair of projections 237*a*, 237*b* are now disengaged and offset from the lock tongue 238. Consequently, the actuator 230 is free to be rotated in the unlocking direction. The engagement between the actuator 230 and the closure member 222 allows for rotation of the closure member 222 by means of the engagement and rotation of the actuator 230.

Figure 17A:
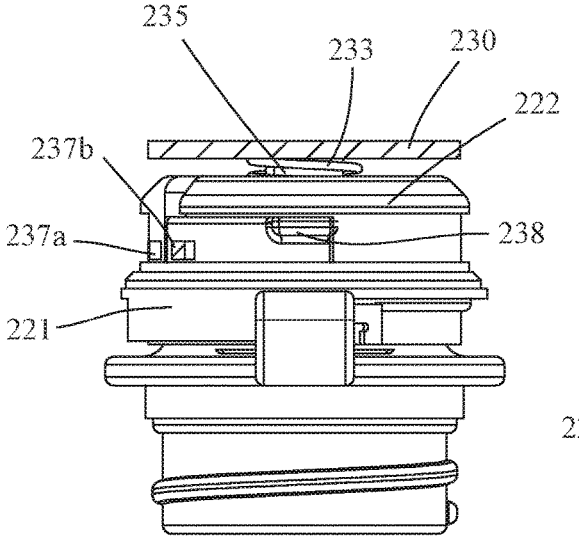
FIGS. 17A-17D are views showing orthogonal views of the closure assembly, with the actuator in the actuated position, and the closure member transitioned to the unlocked position.
Figure 17B:
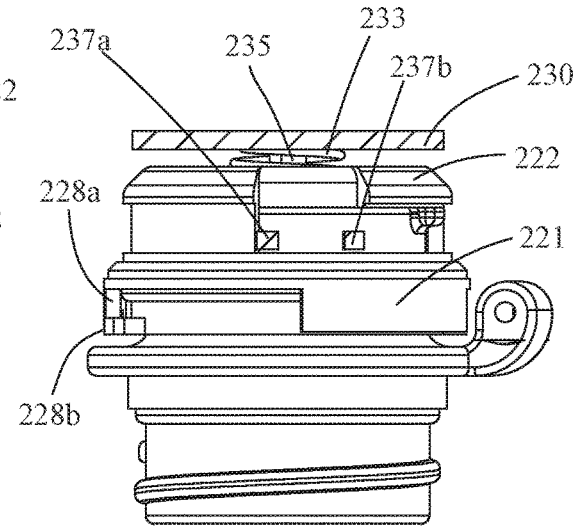
Figure 17C:
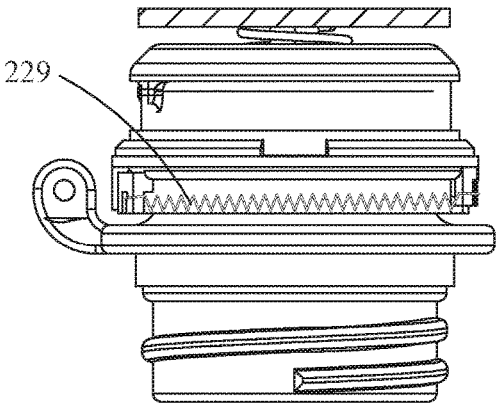
Figure 17D:
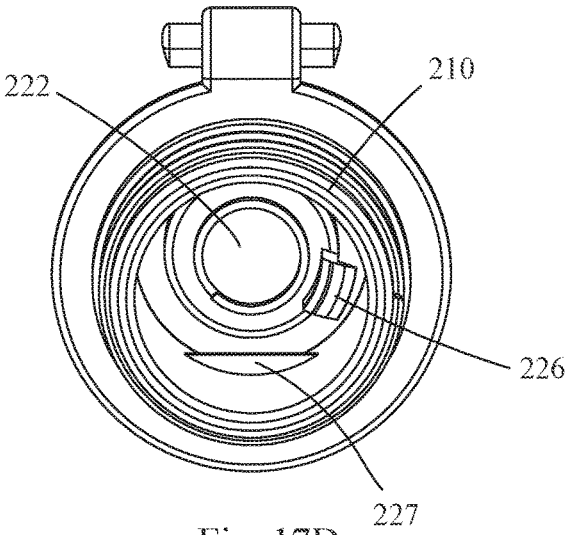

FIG. 17*a* to FIG. 17*d* present different orthogonal views collectively depicting the closure assembly 200 transitioned to the unlocked state. In this state, the lid assembly 220 can be opened without restraint. As shown, the closure member 222 has been rotated to the second position or unlocked position by the actuator 230. Moving to FIG. 17*b*, which provides a right-side view of FIG. 17*a*, it is shown that the stopper 228*a* on the support member 221 making contact with the baffle 228*b* on the closure member 222, which effectively prevents the closure member 222 from rotating beyond the unlocked position. Turning to FIG. 17*c*, a left-side view of FIG. 17*a*, offers a view of the tension spring 229 fully extended within its intended range. Finally, in FIG. 17*d*, a bottom view of FIG. 17*a*, the locking mechanism is shown in its unlocked state, with the detent 226, and the rib 227 being completely disengaged, thereby permitting the lid assembly 220 to swing open freely.

The closure assembly as described in the forgoing is specifically constructed to overcome the mentioned challenges by providing secure, user-friendly, and efficient container sealing, thereby improving product preservation, preventing contamination, and enhancing the overall user experience. By incorporating modern engineering and materials, this invention aims to transform container closures, making them more effective and adaptable for a wide range of applications while promoting sustainability.

It should be understood that although the specification is described in terms of embodiments, not every embodiment includes only a single technical solution. This description of the specification is merely for the sake of clarity. Those skilled in the art should regard the specification as a whole, and the technical solutions in the embodiments can also be combined appropriately to form other embodiments that can be understood by those skilled in the art. However, the protection scope of the present invention is defined by the appended claims rather than the foregoing description, and it is therefore intended that all changes that fall within the meaning and scope of equivalency of the claims are included in the present invention and any reference signs in the claims should not be regarded as limiting the involved claims.

What is claimed is:

1. A closure assembly for a container, comprising:

a coupling member adapted for engaging with an opening of the container; and a lid assembly connected with the coupling member forming a closure for the opening, the lid assembly comprising:

a support member pivotably mounted to the coupling member;

a closure member rotatably supported by the support member for allowing rotational movement with respect to the support member, and adapted for forming a closure engagement with an outlet of the coupling member;

wherein the closure assembly is provided with a locking mechanism configured for selectively maintaining the closure engagement, with the closure member rotatable between a first position in which the closure member and the outlet is sealed, and a second position in which the closure member is free to be disengaged from the outlet, and wherein a gasket is disposed in the closure member for forming a seal with the coupling member.

2. The closure assembly according to claim 1, wherein the locking mechanism comprises a retention member provided on the closure member, the retention member is adapted for engaging or disengaging with a protrusion on the coupling member as a result of rotation of the closure member from the first position to the second position or vice versa.

3. The closure assembly according to claim 2, wherein the retention member is constructed as a detent extending into the outlet, and the protrusion is constructed as a rib disposed within the outlet, during said closure engagement the detent slides towards the rib along a circumferential direction within the outlet.

4. The closure assembly according to claim 1, wherein the closure member is configured to bias towards the first position by a first resilient member provided between the closure member and the support member.

5. The closure assembly according to claim 1, wherein the support member is provided with a stopper adapted for abutment against a baffle provided on the closure member, the abutment restricts the closure member to rotate further beyond the second position.

6. The closure assembly according to claim 1, wherein the closure assembly is releasably coupled to the container through complimentary threads provided on the opening of the container and the coupling member.

7. The closure assembly according to claim 1, comprising an actuating mechanism for isolating direction manipulation of the closure member by a user, while selectively restricting or driving the rotation of the closure member by means of an actuator.

8. The closure assembly according to claim 7, wherein the actuator is constructed as a cap substantially encloses the closure member, the actuator is configured to engage with the closure member which rotatably supports the actuator.

9. The closure assembly according to claim 8, wherein the closure member is provided with an upper annular slot for engagement with one or more arcuate protrusions provided within the actuator.

10. The closure assembly according to claim 8, wherein the actuator is adapted for moving coaxially with respect to the closure member between an actuated position in which the actuator is rotatable with the closure member, and a de-actuated position in which rotation of the actuator is restricted.

11. The closure assembly according to claim 10, wherein the actuator is provided with a drive protrusion engageable with a corresponding drive slot provided on the closure member, such that upon engagement the actuator drives the rotation of the closure member.

12. The closure assembly according to claim 11, wherein the actuator is configured to bias towards the de-actuated position by a second resilient member provided between the closure member and the actuator.

13. The closure assembly according to claim 12, wherein the actuator is provided with a lock catch that protrudes through an open slot disposed within the upper annular slot, in the de-actuated position the lock catch is engaged with a lock tongue provided on the coupling member, thereby restricts the rotation of the actuator.

14. The closure assembly according to claim 13, wherein in the actuated position the lock catch is offset from the lock tongue, thereby allows the actuator to rotate.

15. A closure assembly for a container, comprising:

a coupling member adapted for engaging with an opening of the container; and a lid assembly releasably connected with the coupling member, the coupling member and the lid assembly forming a closure for the opening, the lid assembly comprising:

a support member pivotably connected with the coupling member;

a closure member rotatably supported by the support member for allowing relative rotation, the closure member adapted for forming a seal with an outlet of the coupling member;

wherein the closure assembly further comprises:

a locking mechanism configured for selectively maintaining the closure engagement, with the closure member operatively rotatable between a first position in which the seal between the closure member and the outlet is maintained, and a second position in which the closure member is free to be disengaged from the outlet; and an actuating mechanism that isolates the closure member from direct manipulation by a user, and is configured for selectively allowing and restricting rotation of the closure member by means of an actuator.

16. The closure assembly according to claim 15, wherein the actuator is constructed as a cap fitted over the closure member, the actuator is configured for selectively engaging with the closure member which rotatably supports the actuator.

17. The closure assembly according to claim 15, wherein the actuator is adapted for moving coaxially with respect to the closure member between an actuated position in which the actuator is rotatable with the closure member, and a de-actuated position in which rotation of the actuator is restricted.

18. The closure assembly according to claim 17, wherein the actuator is provided with a drive protrusion engageable with a corresponding drive slot provided on the closure member, such that upon engagement the actuator drives the rotation of the closure member.

19. The closure assembly according to claim 18, wherein the actuator is configured to bias towards the de-actuated position by a second resilient member provided between the closure member and the actuator.

* * * * *